US010651582B2

(12) United States Patent
Lee et al.

(10) Patent No.: US 10,651,582 B2
(45) Date of Patent: May 12, 2020

(54) CONNECTOR

(71) Applicant: 3M INNOVATIVE PROPERTIES COMPANY, St. Paul, MN (US)

(72) Inventors: Kok Hoe Lee, Singapore (SG); Saujit Bandhu, Singapore (SG); YunLong Qiao, Singapore (SG); Rao L. Vittapalli, Singapore (SG); Chin Hua Lim, Singapore (SG)

(73) Assignee: 3M INNOVATIVE PROPERTIES COMPANY, St. Paul, MN (US)

( * ) Notice: Subject to any disclaimer, the term of this patent is extended or adjusted under 35 U.S.C. 154(b) by 0 days.

(21) Appl. No.: 15/520,093

(22) PCT Filed: Oct. 26, 2015

(86) PCT No.: PCT/US2015/057316
§ 371 (c)(1),
(2) Date: Apr. 19, 2017

(87) PCT Pub. No.: WO2016/073232
PCT Pub. Date: May 12, 2016

(65) Prior Publication Data

US 2017/0310029 A1 Oct. 26, 2017

(30) Foreign Application Priority Data

Nov. 3, 2014 (SG) ..... 10201407153Q

(51) Int. Cl.
*H01R 12/72* (2011.01)
*H01R 13/453* (2006.01)
(Continued)

(52) U.S. Cl.
CPC ..... *H01R 12/725* (2013.01); *H01R 13/4538* (2013.01); *H01R 13/6583* (2013.01);
(Continued)

(58) Field of Classification Search
CPC ..... H01R 13/4538; H01R 12/725; H01R 13/6583
(Continued)

(56) References Cited

U.S. PATENT DOCUMENTS 4,695,925 A * 9/1987 Kodai ..... G06K 19/077 235/492
4,843,226 A * 6/1989 Kato ..... G06K 19/07743 235/487
(Continued)

FOREIGN PATENT DOCUMENTS

EP 2169774 3/2010
JP 2000171724 6/2000
(Continued)

OTHER PUBLICATIONS

International Search Report for PCT International Application No. PCT/US2015/057316, dated Feb. 2, 2016, 7 pages.

*Primary Examiner* — Tulsidas C Patel
*Assistant Examiner* — Marcus E Harcum
(74) *Attorney, Agent, or Firm* — Michael Stern

(57) ABSTRACT

In a specific embodiment, a connector 100 is disclosed. The connector 100 comprises an insulative housing 102 defining a rear opening 108 for receiving a plurality of electrical wires 110 and a front opening 106 and a circuit board 104 disposed in the housing 102 and comprising a mating section 112 for mating with a corresponding mating section of a mating connector. The mating section 112 protrudes outwardly from the front opening 106 and terminates at a front edge 118 disposed between opposing side edges 114,116 of the mating section 112. The connector 100 further comprises opposing side arms 128,130 extending forwardly from opposing lateral sides 124,126 of the front opening 106 along, adjacent and beyond corresponding side edges 114, 116 of the mating section 112 with a maximum separation
(Continued)

between each side edge 114,116 and the corresponding side arm 128,130 being sufficiently small so that when the connector 100 mates with a mating connector, no portion of the mating connector can be inserted between the side edge 114,116 and the corresponding side arm 128,130. Other exemplary embodiments are also disclosed.

12 Claims, 21 Drawing Sheets

(51) Int. Cl.
*H01R 13/6583* (2011.01)
*H01R 13/6594* (2011.01)

(52) U.S. Cl.
CPC ..... *H01R 12/724* (2013.01); *H01R 12/727* (2013.01); *H01R 13/6594* (2013.01)

(58) Field of Classification Search
USPC ..... 439/350, 607.53, 607.57, 76.1
See application file for complete search history.

(56) References Cited

U.S. PATENT DOCUMENTS 4,857,005 A * 8/1989 Kikuchi ..... G06K 7/0047 439/140
5,108,294 A * 4/1992 Marsh ..... H01R 13/6473 439/607.01
5,112,233 A 5/1992 Lybrand
6,431,887 B1 * 8/2002 Yeomans ..... H01R 13/6583 439/108
6,752,663 B2 6/2004 Bright
7,175,444 B2 2/2007 Lang
7,448,897 B2 11/2008 Dawiedczyk
7,572,145 B1 * 8/2009 Wu ..... H01R 13/6658 439/460
7,648,372 B2 * 1/2010 Wu ..... H01R 13/516 439/41
7,938,669 B2 * 5/2011 Li ..... H01R 13/6275 439/352
9,017,091 B2 * 4/2015 Zhu ..... H01R 13/512 439/352
2002/0115333 A1 8/2002 Self
2008/0032540 A1 * 2/2008 Fukushima ..... H01R 13/5045 439/350
2011/0097932 A1 4/2011 Aihara
2014/0206209 A1 * 7/2014 Kamei ..... H01R 24/60 439/81
2014/0286613 A1 9/2014 Ito
2015/0162701 A1 * 6/2015 Wu ..... H01R 24/60 439/606

FOREIGN PATENT DOCUMENTS

WO WO 2003-073559 9/2003
WO WO 2010-085465 7/2010
WO WO 2014-099331 6/2014

* cited by examiner

CONNECTOR

FIELD & BACKGROUND

The present application relates to a connector. More specifically, in at least one aspect, the present application relates to an electrical connector for connecting an electrical cable to a printed circuit board.

Cable connector assemblies are used commonly to connect electrical cables to a printed circuit board (PCB). A typical cable connector assembly may comprise a plug connector and a receptacle connector arranged to mate with the plug connector. The electrical cables terminate at a printed circuit card of the plug connector and the printed circuit card includes electrical contacts for connecting to electrical terminals of the receptacle connector which is mounted to the PCB.

It is usual to encapsulate the printed circuit card to form a plug/header and the encapsulation provides protection against any damage to the printed circuit card and soldering/termination areas with the electrical cables. The encapsulation may also have additional guiding and polarization features for more efficient mating with the receptacle connector. However, such encapsulations are not versatile to be mated with different receptacle connectors or sockets.

Further, as electrical signal transmission speed increases, electromagnetic interference (EMI) needs to be controlled or minimised so as not to degrade integrity of the electrical signals.

It is an object of the present invention to provide a connector to address at least one of the problems of the prior art and/or to provide the public with a useful choice.

SUMMARY

According to a first aspect, there is provided a connector comprising: an insulative housing defining a rear opening for receiving a plurality of electrical wires and a front opening; a circuit board disposed in the housing and comprising a mating section for mating with a corresponding mating section of a mating connector, the mating section protruding outwardly from the front opening and terminating at a front edge disposed between opposing side edges of the mating section; and at least one side arm extending forwardly from a lateral side of the front opening along, adjacent and beyond one of the side edges of the mating section, a maximum separation between the side edge and the at least one side arm being sufficiently small so that when the connector mates with a mating connector, no portion of the mating connector can be inserted between the side edge and the at least one side arm.

With such an arrangement, it provides the opposing side arms may assist to protect the circuit board from damage during mating and at the same time, may provide alignment during mating, without a need for an "outermold".

Preferably, the at least one side arm may make physical contact with the corresponding side edge of the mating section. Indeed, the maximum separation between the at least one side arm and the corresponding side edge may be zero. The at least one side arm may be overmolded on at least a portion of the corresponding side edge of the circuit board.

It is possible that the mating section of the circuit board may comprise a plurality of contact pads for making electrical contact with corresponding contacts of a mating connector, and wherein the opposing side arms are overmolded on the circuit board leaving exposed the plurality of contact pads.

Advantageously, the at least one side arm includes a side arm centre axis which is offset from the front edge's centre axis, and such an arrangement may be used as a polarising feature. It is possible that the connector may further comprise an outer shell housing arranged to enclose the insulative housing. With the outer shell housing, the connector may further comprise a latch mechanism mounted to the outer shell housing and for engaging with a mating connector. As an example, the latch mechanism may comprise at least one catch member for engaging with a mating connector.

Preferably, the connector may further comprise an electrically conductive shield covering a major surface of the mating section of the circuit board and being resiliently retractable to a retracted position exposing the major surface of the mating section. The shield may be used to reduce undesirable effects of electromagnetic interference (EMI). Specifically, the major surface may be a top surface of the mating section.

In a specific embodiment, the at least one side arm may include opposing side arms extending from opposing lateral sides of the front opening along, adjacent and beyond corresponding side edges of the mating section, wherein the maximum distance between each side edge and the corresponding side arm is sufficiently small so that when the connector mates with the mating connector, no portion of the mating connector can be inserted between the side edge and the corresponding side arm.

According to a second aspect, there is provided a connector comprising: an insulative housing defining a rear opening for receiving a plurality of electrical wires and a front opening; a circuit board disposed in the housing and comprising a mating section comprising a plurality of contact pads for making electrical contact with corresponding contacts of a mating connector, the mating section protruding outwardly from the front opening; and an electrically conductive shield covering a major surface of the mating section of the circuit board and being resiliently retractable to a retracted position exposing the top surface of the mating section.

This arrangement may help to absorb or cushion any excessive impact force during mating of the connector with a mating connector, and also reduce undesirable effects of electromagnetic interference (EMI).

In a specific embodiment, the major surface may be a top surface of the mating section. When the mating section mates with a corresponding section of a mating connector, the electrically conductive shield is arranged to retract to the retracted position. In such an arrangement i.e. the connector of the second aspect with the mating connector, the retracted shield may be replaced with a shield of the mating connector.

The mating section of the circuit board may comprise two major surfaces including a top surface and a lower surface, and wherein the electrically conductive shield may include an upper shield member for covering the top surface and a lower shield member for covering the bottom surface. Each of the upper and lower shield members may comprise a front cover arranged to cover the respective top and bottom surfaces, a loop section attached to a part of the insulative housing and a resiliently biased linkage section coupled between the front cover and the loop section.

Preferably, the front cover may include opposing side shields for hugging a part of the insulative housing. The insulative housing may include opposing side arms extending forwardly from opposing lateral sides of the front opening, and the opposing side shields may be arranged to hug a respective side arm.

In a specific embodiment, the mating section may be arranged to protrude outwardly from the front opening and terminates at a front edge disposed between opposing side edges of the mating section; and wherein the connector further comprises at least one side arm extending forwardly from a lateral side of the front opening along, adjacent and beyond one of the side edges of the mating section, a maximum separation between the side edge and the at least one side arm being sufficiently small so that when the connector mates with a mating connector, no portion of the mating connector can be inserted between the side edge and the at least one side arm.

The at least one side arm may include a side arm centre axis which is offset from the front edge's centre axis, and this may be useful as a polarising feature.

Specifically, the at least one side arm may include opposing side arms extending from opposing lateral sides of the front opening along, adjacent and beyond corresponding side edges of the mating section, wherein the maximum distance between each side edge and the corresponding side arm may be sufficiently small so that when the connector mates with the mating connector, no portion of the mating connector can be inserted between the side edge and the corresponding side arm.

Preferably, a leading edge of the electrically conductive shield may be in line with the front edge of the mating section.

According to a third aspect, there is provided a connector comprising: an insulative housing comprising a plurality of passageways; a plurality of electrically conductive contacts, each contact defining a plane of the contact and disposed in a corresponding passageway and comprising: a contact portion disposed in a mating section of the connector for making electrical contact with a corresponding contact of a mating connector; a termination portion extending outwardly from a rear of the insulative housing; and a middle portion connecting the contact portion to the termination portion, wherein the middle portion of each contact is disposed between opposing sidewalls, each sidewall comprising a first planar surface facing the contact and terminating at a peak of the side wall and making a first acute angle of 4 to 11 degrees with the plane of the contact.

With such an arrangement, it is possible to reduce impedance mismatch between the electrically conductive contacts and the sidewalls.

Each sidewall may further comprise a second planar surface extending downwardly from the first planar surface and making a second acute angle with the plane of the contact, the second acute angle being less than the first acute angle. Preferably, the second acute angle may be substantially equal to zero. In an embodiment, the peak of the side wall is substantially aligned with a highest point of the contacts. Each sidewall may include a base having a base width which is substantially the same as a width of each of the contacts.

According to a fourth aspect, there is provided a connector assembly comprising: a shielded connector and an electrically conductive cage. The shielded connector comprises an insulative housing comprising a plurality of passageways; a plurality of electrically conductive contacts, and an electrically conductive shield assembled to an exterior of and enclosing the mating section of the connector. Each electrically conductive contact is disposed in a corresponding passageway and comprises a contact portion disposed in a mating section of the connector for making electrical contact with a corresponding contact of a mating connector; a termination portion extending outwardly from a rear of the insulative housing; and a middle portion connecting the contact portion to the termination portion. The electrically conductive cage comprising opposing top and bottom walls, opposing side walls and a back wall defining a receiving space communicating with a front opening, the bottom wall defining a bottom opening at a rear portion of the bottom wall adjacent the back wall, the top wall defining a top opening at a front of the top wall adjacent the front opening, wherein the shielded connector is received by the cage through the bottom opening, the top opening partially exposing the electrically conductive shield of the shielded connector, and a mating connector of the shielded connector mates with the connector through the front opening of the cage.

When a mating connector having a resiliently retractable electrically conductive shield mates with the shielded connector through the front opening of the cage, the electrically conductive shield of the connector contacts the resiliently retractable electrically conductive shield of the mating connector and this may cause it to retract. Preferably, the retracted electrically conductive shield of the mating connector may be replaced with the electrically conductive shield of the connector.

The mating connector may include the connector of the second aspect as an example.

In a specific embodiment, the electrically conductive shield may include a bracket arranged to enclose the insulative housing. The bracket may include engagement tabs for engaging with respective legs of the electrically conductive cage.

Preferably, the electrically conductive cage may include an engagement mechanism arranged to frictionally engage the shielded connector, and the engagement mechanism may be arranged to frictionally engage rear portions of the electrically conductive shield and the insulative housing.

In one embodiment, the insulative housing may include opposing side housing walls at the rear of the insulative housing, and the electrically conductive shield includes wing sections arranged to shield the respective the side housing wall, and the engagement mechanism is arranged to frictionally engage a corresponding side housing wall of the insulative housing and the wing section of the conductive shield. Specifically, the engagement mechanism may include two rear spring clips mounted to the respective side walls of the cage and disposed near the back wall of the cage. Advantageously, the engagement mechanism is further arranged to frictionally engage the mating connector. Specifically, the engagement mechanism may include two front spring clips mounted to the respective side walls of the cage and disposed near the front opening of the cage.

The connector assembly may further comprise the connector of the second aspect, wherein when the connector may be arranged to mate with the shielded connector through the front opening of the cage, the electrically conductive shield of the shielded connector may be arranged to contact the resiliently retractable electrically conductive shield of the connector to cause the resiliently retractable electrically conductive shield to retract to the retracted position.

In a fifth aspect, there is provided a connector assembly, comprising: a first connector comprising: a first mating section comprising a plurality of first terminals; and a first electrically conductive shield shielding the first terminals;

and a second connector for mating with the first connector and comprising: a second mating section comprising a plurality of second terminals; and a resiliently retractable second electrically conductive shield shielding the second terminals; such that when the second connector mates with the first connector, corresponding terminals in the pluralities of first and second terminals contact one another, the second shield resiliently retracts away from the second terminals, and the first shield provides shielding for both the first and second terminals.

When the second connector unmates from the first connector, the retracted second shield may return to its original position and provides shielding for the second terminals.

It should be apparent that features relating to one aspect of the invention may also be applicable to the other aspects of the invention.

These and other aspects of the invention will be apparent from and elucidated with reference to the embodiments described hereinafter.

BRIEF DESCRIPTION OF THE DRAWINGS

Embodiments of the invention are disclosed hereinafter with reference to the accompanying drawings, in which.

DETAILED DESCRIPTION OF PREFERRED EMBODIMENTS

Figure 2:
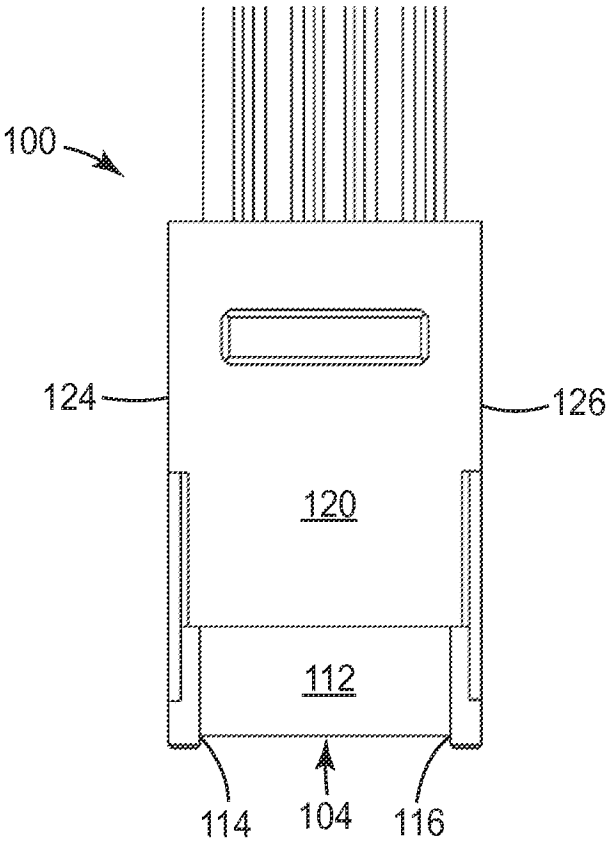
FIG. 2 is a top view of the plug connector of FIG. 1.
Figure 1:
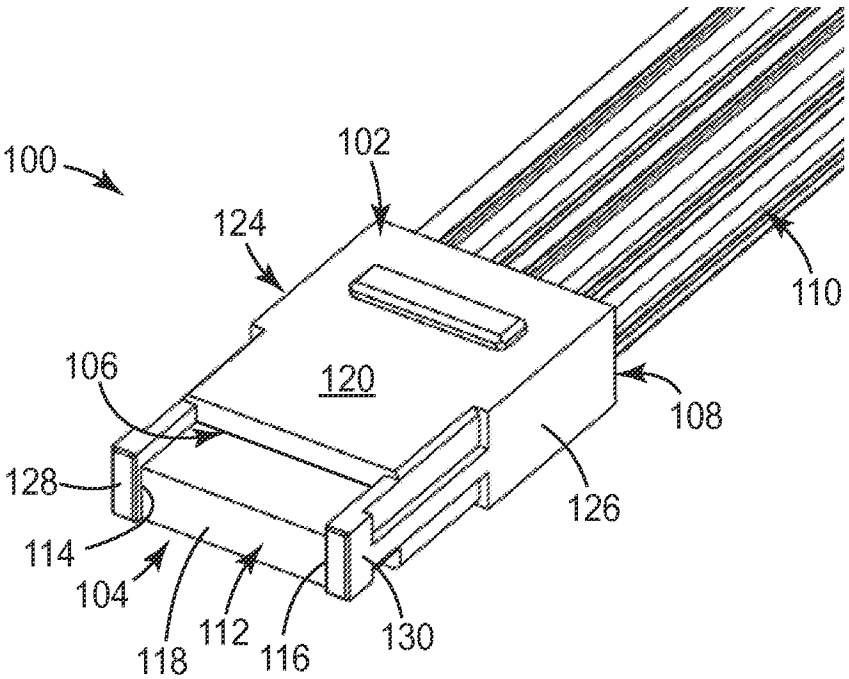
FIG. 1 is a perspective view of a plug connector according to a first embodiment of the invention.
Figure 4:
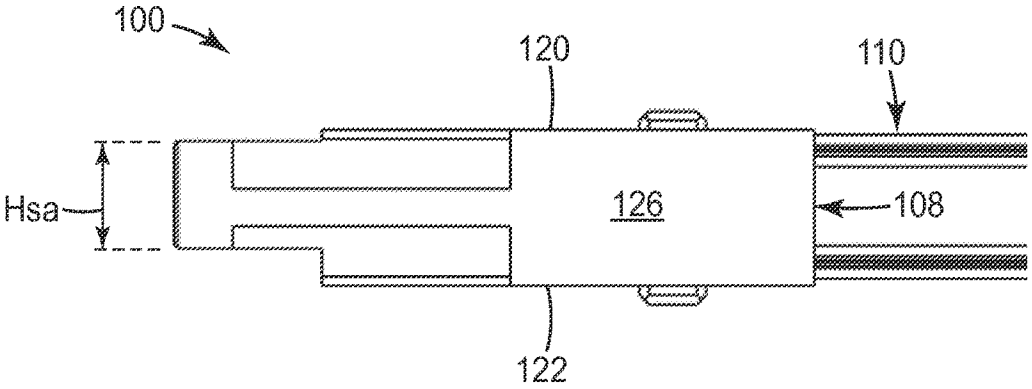
FIG. 4 is a side view of the plug connector of FIG. 1.
Figure 3:
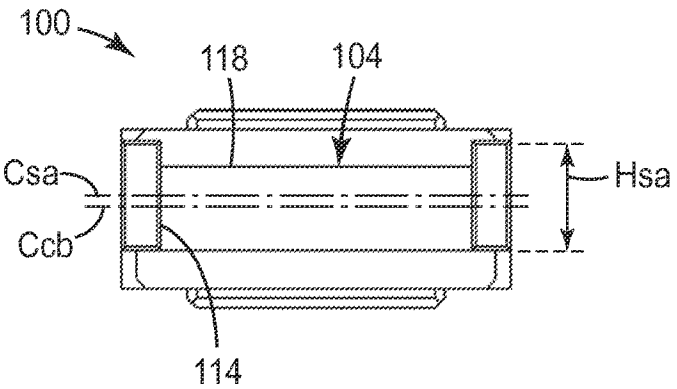
FIG. 3 is a front view of the plug connector of FIG. 1.

FIG. 1 is a connector in the form of plug connector 100 according to a first embodiment of the invention and FIGS. 2, 3 and 4 are top, front and side views, respectively, of the plug connector of FIG. 1. The plug connector 100 includes an insulative housing 102 and a circuit board 104 disposed in the insulative housing 102. In this embodiment, the insulative housing 102 is moulded with the circuit board 104 and the insulative housing 102 includes a front opening 106 and a rear opening 108 for receiving a plurality of electrical wires 110.

The circuit board 104 comprises a mating section 112 for mating with a corresponding mating section of a mating connector (not shown). As shown in FIG. 1, the mating section 112 is arranged to protrude outwardly of the front opening 106. The mating section 112 of the circuit board 104 includes opposing side edges 114,116 and terminates at a front edge 118 disposed between the opposing side edges 114,116. It should be appreciated that the shape and size of the mating section 112 may be adapted according to requirements (and the corresponding mating section of the mating connector).

The insulative housing 102 includes top and bottom portions 120,122 and first and second lateral sides 124,126 which partially encapsulates the circuit board 104. It should be appreciated that the top portion 120, the bottom portion 122, the opposing first and second lateral sides 124,126 cooperate to define the front opening 106 and the rear opening 108.

The insulative housing 102 further includes first and second side arms 128,130 arranged opposite to each other and which extend forwardly from the respective first and second lateral sides 124,126. It should be appreciated that the first and second side arms 128,130 are arranged along, adjacent and beyond the corresponding side edges 114,116 of the mating section 112 of the circuit board 104 to prevent a portion of the mating connector from being insertable between side arms 128,130 and the corresponding side edges 114,116. In other words, a maximum separation distance, if any, between the first side arm 128 and the first side edge 114, and between the second side arm 130 and the second side edge 116, is sufficiently small so that when the plug connector 100 mates with the mating connector, no portion of the mating connector can be inserted between the side edges 114,116 and the corresponding side arms 128, 130. In this way, the first and second side arms 128,130 are arranged to protect the circuit board 104 from damage during the mating process and at the same time, may provide alignment during mating.

In the first embodiment, as it can be seen from FIGS. 1 and 3, each of the first and second side arms 128,130 are arranged to make physical contact with the corresponding first and second side edges 114,116 and indeed, the maximum separation distance may be zero. For ease of manufacturing, each of the first and second side arms 128,130 may be overmolded on at least a portion of the corresponding first and second side edges 114,116 of the circuit board.

Although not shown in the drawings, it should be appreciated that the mating section 112 of the circuit board 104 may include a plurality of contact pads for making electrical contact with corresponding electrical contacts of the mating connector and in this case, the opposing first and second side arms 128,130 may be overmolded on the circuit board leaving exposed the plurality of contact pads for mating with the corresponding mating connector.

From FIG. 3, it should be appreciated that, in the first embodiment, each side arm 128,130 is symmetrical to each other and has a height of Hsa and it is relatively easy to identify a centre or midpoint of side arms 128,130. A first imaginary line connecting the two centres is referred to as a centreline of the side arms Csa. Similarly, a centre or midpoint of the circuit board 104 may also be identified and a second imaginary line through the centre of circuit board 104 is referred to as Ccb. It should be apparent from FIG. 3 that the centreline of the circuit board Ccb is offset from the centreline of the side arms Csa by a certain distance of about 0.35 mm. Or to put it another way, the centre of the side arms 128,130 is offset from the centre of the circuit board 104. This asymmetrical distance allows polarisation of the mating position of the plug connector 100 to ensure that the correct side of the circuit board is mated with a corresponding mating connector (since if the plug connector 100 is rotated the other way round, it would not be possible to insert the plug connector 100 into the mating connector due to the offset). Needless to say, the distance of 0.35 mm may change or adapted according to design changes and technical requirements.

Figure 6:
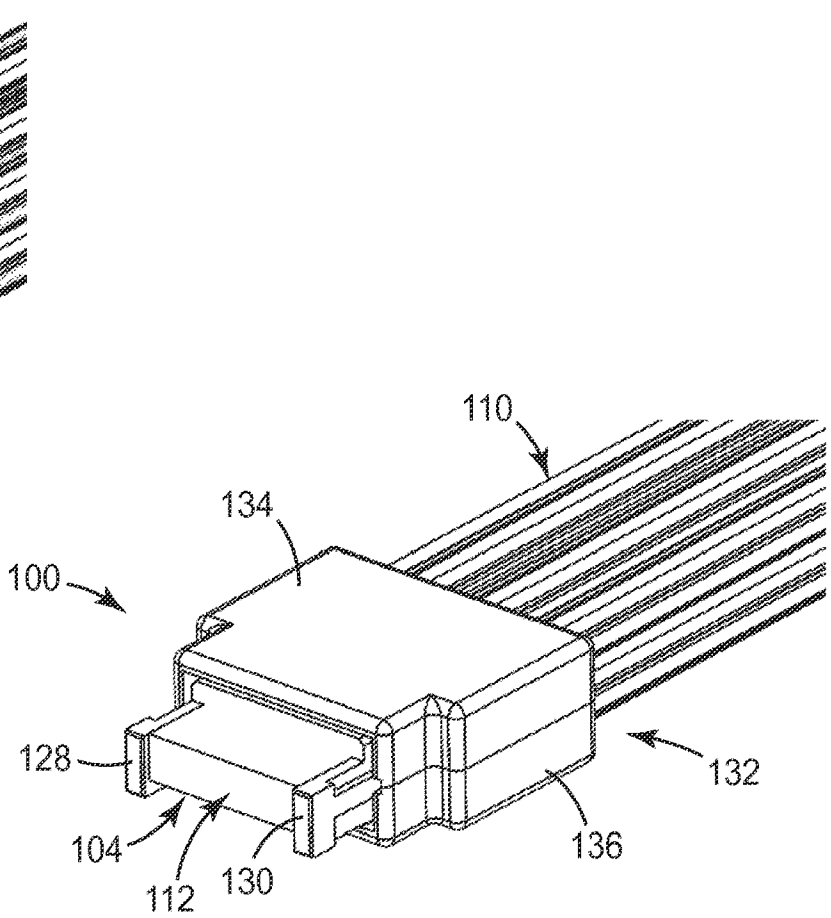
FIG. 6 shows the plug connector of FIG. 5 with the outer shell housing assembled.
Figure 5:
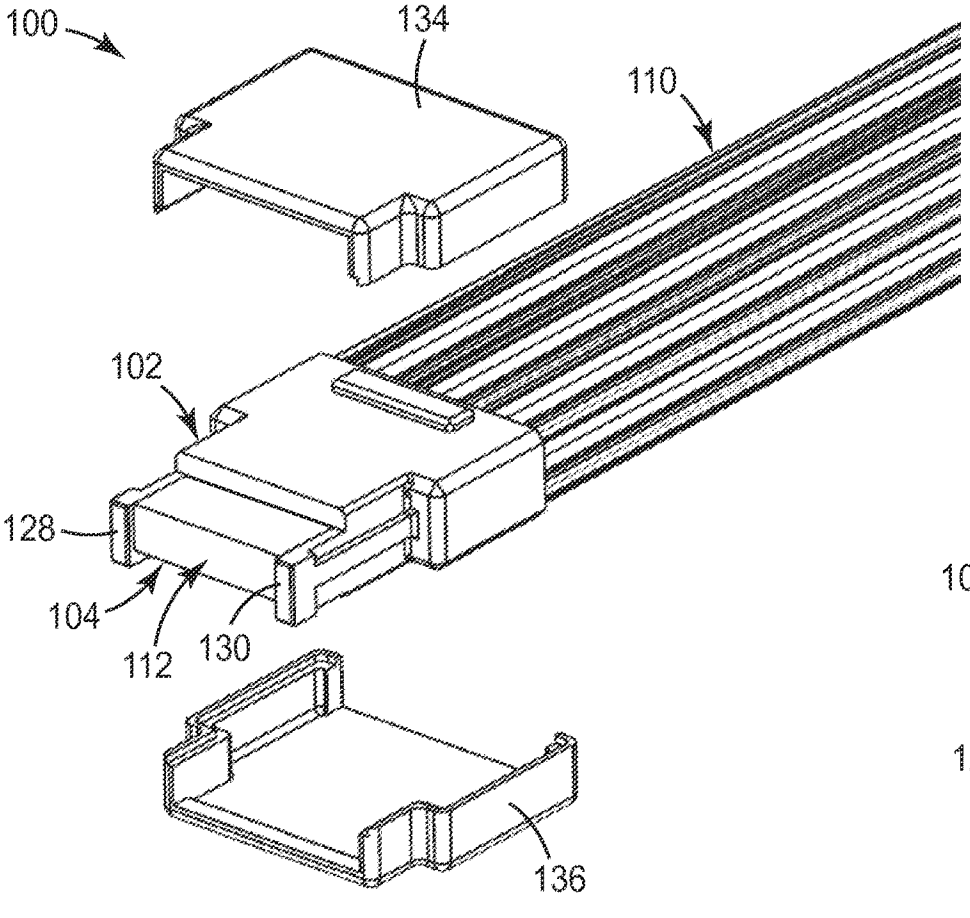
FIG. 5 shows the plug connector of FIG. 1 being provided with an outer shell housing which is unassembled and separated.

It should be appreciated that the insulative housing 102 functions as an overmold and an additional outer housing may not be needed to enclose the circuit board 104. However, it is also possible that the plug connector 100 includes an outer shell housing 132 comprising a top shell half 134 and a bottom shell half 136 cooperating with each other to define the outer shell housing 132 as shown in FIGS. 5 and 6. In such a configuration, the outer shell housing 132 covers the insulative housing 102 and leaving the mating section 112 of the circuit board 104 and the first and second side arms 128,130 exposed or unobstructed. In other words, although the insulative housing 102 functions as an innermold with respect to the outer shell housing 132, it should be appreciated that it is the insulative housing with its first and second side arms 128,130, and not the outer shell housing 132, which is arranged to polarise, align and/or guide the circuit board when mating with the corresponding mating connector for electrical connection.

The presence of the outer shell housing 132 provides additional protection against increased impact and/or electrical shielding, and indeed, with the outer shell housing 132, further improvements may be made to the plug connector 100 as will be described next in a second embodiment.

Figure 8:
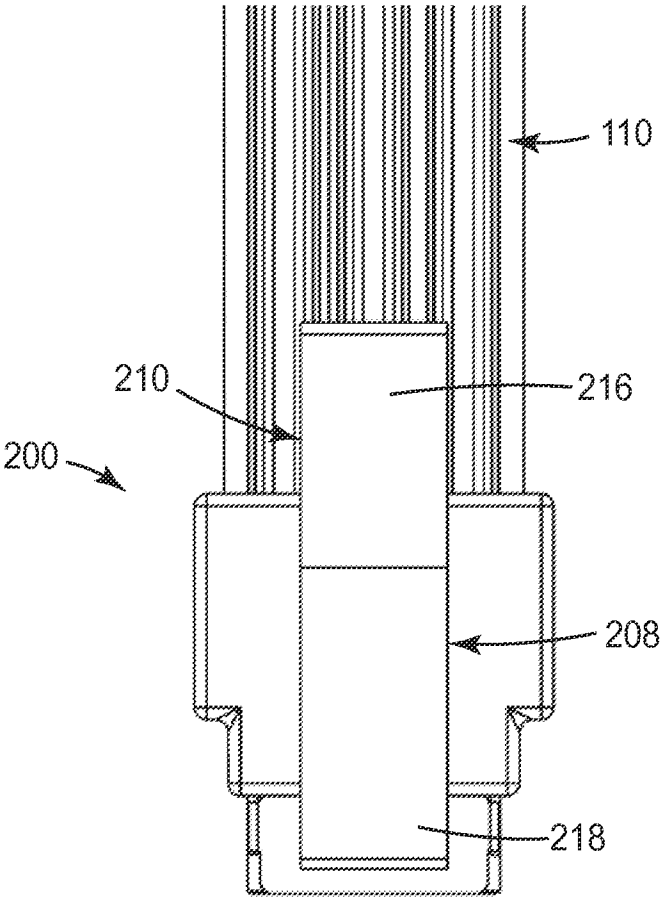
FIG. 8 is a top view of the deflectable plug connector of FIG. 7.
Figure 7:
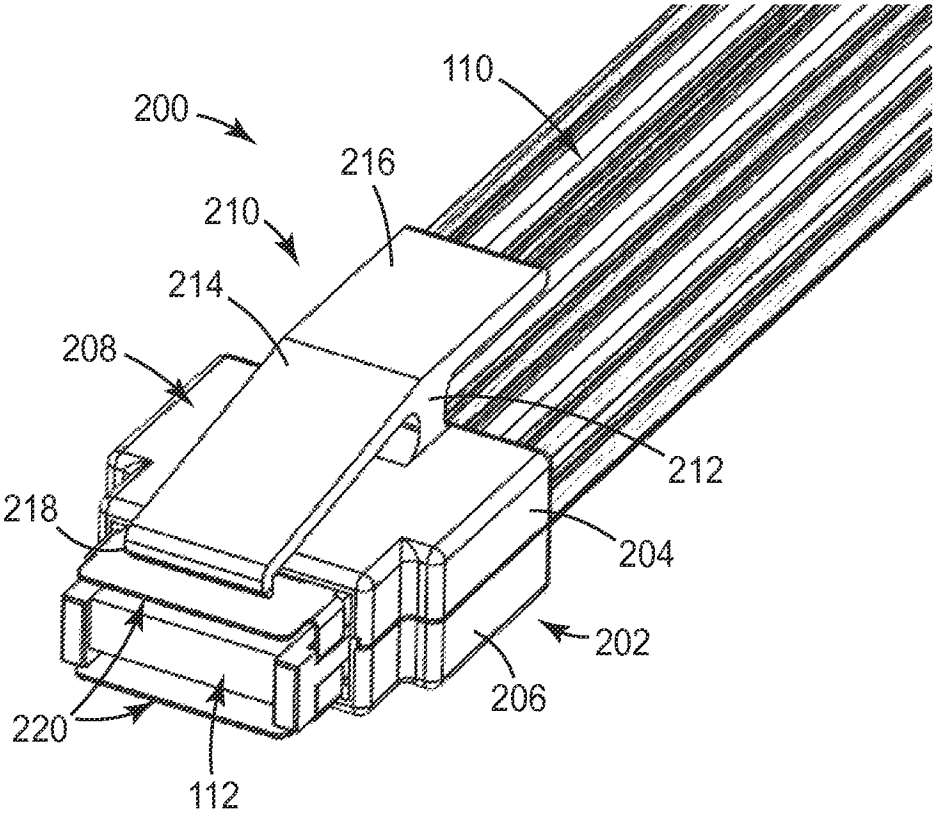
FIG. 7 is a perspective view of a deflectable plug connector according to a second embodiment of the invention.
Figure 10:
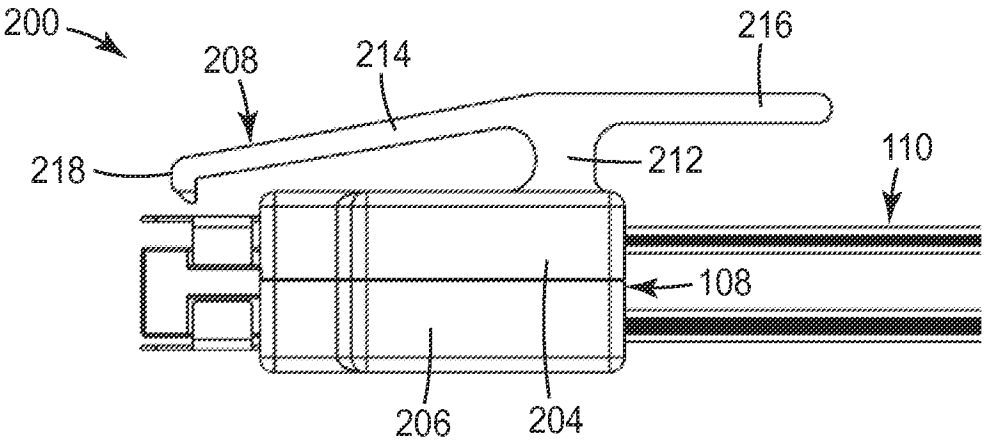
FIG. 10 is a side view of the deflectable plug connector of FIG. 7.
Figure 9:
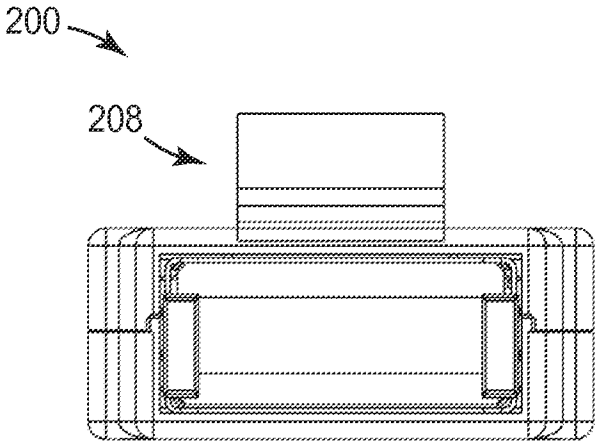
FIG. 9 is a front view of the deflectable plug connector of FIG. 7.

FIG. 7 is a connector in the form of a deflectable plug connector 200 according to the second embodiment, and FIGS. 8, 9 and 10 are top, front and side views, respectively, of the deflectable plug connector 200 of FIG. 7. The deflectable plug connector 200 includes the plug connector 100 of the first embodiment and the entire device would be referred to as the deflectable plug connector 100 and like parts will use the same references. Instead of the outer shell housing 132 of the first embodiment, the deflectable plug connector 200 includes an outer housing 202 comprising a top housing half 204 and a bottom housing half 206 coupled to the top housing half 204 to enclose the plug connector 100 of the first embodiment, similar to the outer shell housing 132. However, the outer housing 202 of the deflectable plug connector 200 includes a latch mechanism 208 for securing the deflectable plug connector 200 to a mating connector (not shown).

In the second embodiment, the latch mechanism 208 includes an upper catch member 210 mounted to the top housing half 204. The upper catch member 210 includes a pivoting base 212 supporting a pivoting arm 214 with a finger portion 216 at one end near to the rear opening 108 and a catch portion 218 at the other end which extends beyond the front opening 106 and above the mating section 112. The pivoting base 212 is arranged nearer to the finger portion 216 with the catch portion 218 biased towards the mating section 112 of the circuit board 104 under rest condition. In this way, the pivoting base 212 and the pivoting arm 214 act like a lever and depressing the finger portion 216 towards the outer housing 202 would pry the catch portion 218 away from the mating section 112 or to an open position to allow the mating connector to be engaged with the deflectable plug connector 200 and for the catch portion 218 to be latched to a catch engaging portion of the mating connector. This allows the deflectable plug connector 200 to be securely engaged to the mating connector.

Figure 11:
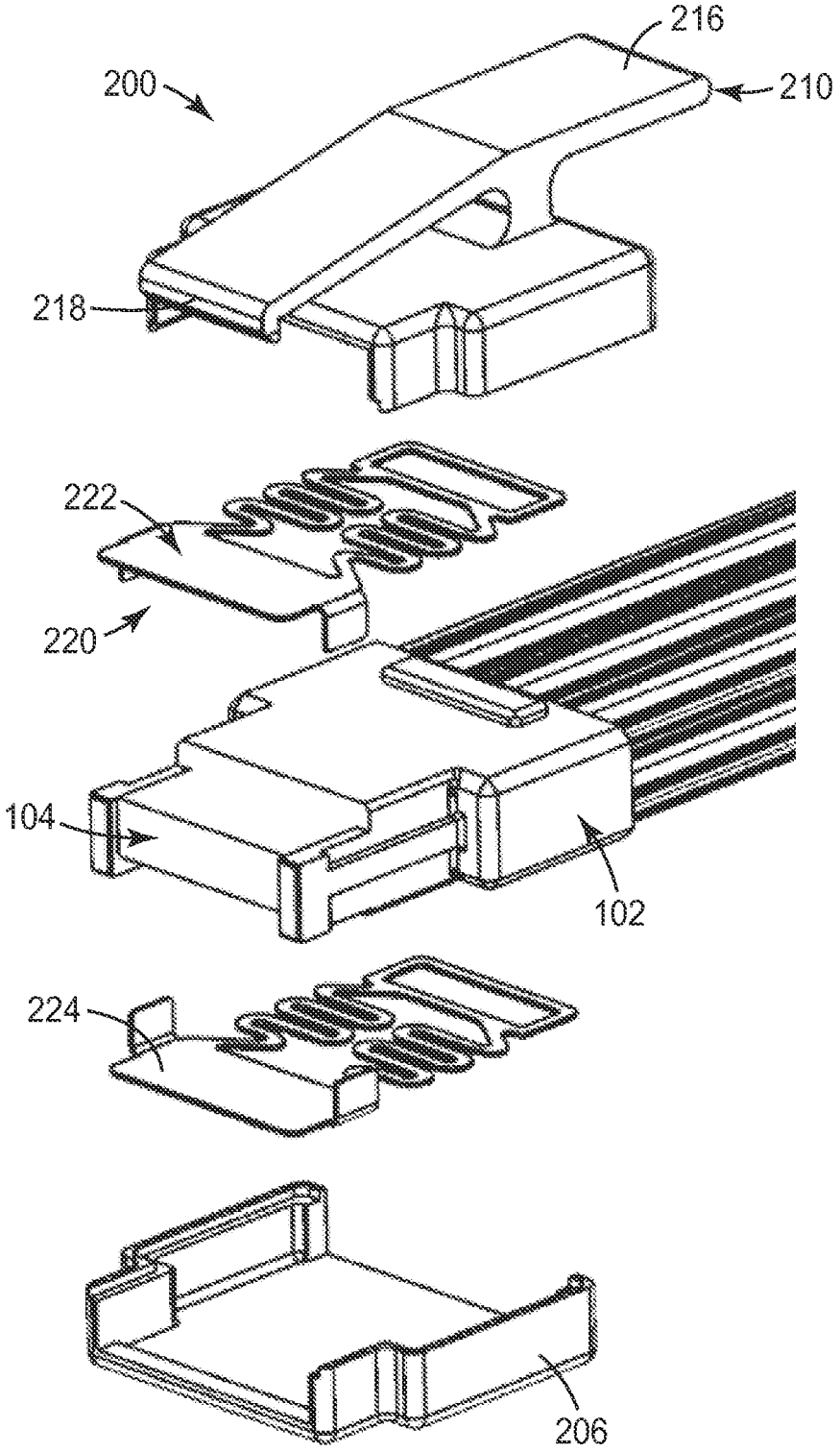
FIG. 11 is an exploded perspective view of the deflectable plug connector of FIG. 7 to show an electrically conductive shield beneath an outer housing.
Figure 12:
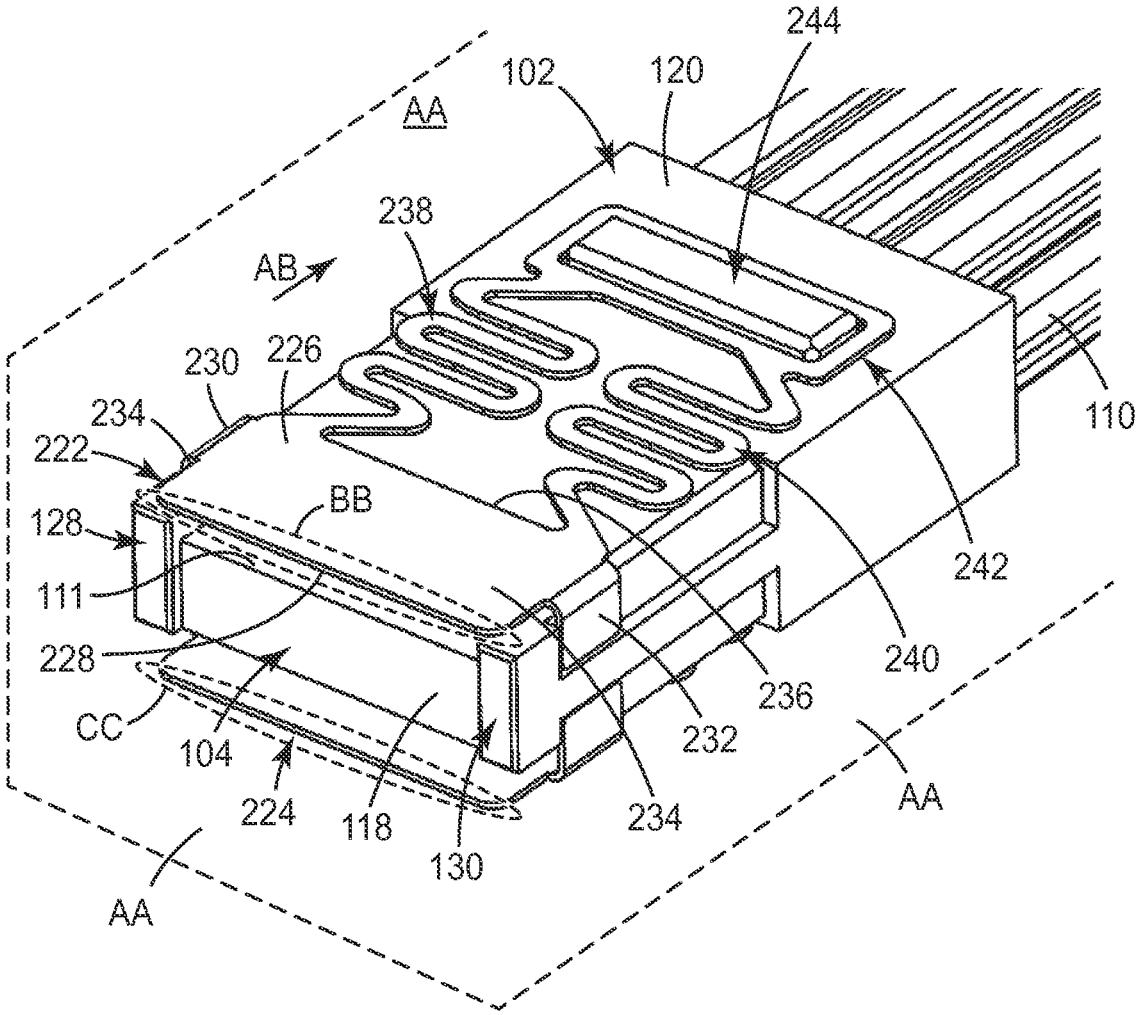
FIG. 12 is an enlarged view of the deflectable plug connector of FIG. 11 with the outer housing omitted and to illustrate the electrically conductive shield more clearly.

The deflectable plug connector 200 further includes an electrically conductive shield 220 which is resiliently retractable for shielding of the deflectable plug connector 200 from EMI, for example. FIG. 11 shows an exploded view of the deflectable plug connector 200 to show the electrically conductive shield 220 arranged to cover at least one major surface of the mating section 112 and FIG. 12 shows the conductive shield 220 more clearly.

In the second embodiment, the electrically conductive shield 220 includes an upper shield member 222 arranged on the top portion 120 of the insulative housing 102 and a lower shield member 224 arranged on the bottom portion 122 of the insulative housing 102. In this embodiment, the mating section 112 includes two major surfaces in the form of a top surface 111 and a lower surface 113 and the upper shield member 222 and the lower shield member 224 is arranged to cover respectively the top surface 111 and the lower surface 113. Since the lower shield member 224 is structurally similar to the upper shield member 222, only the upper shield member 222 will be described, with reference to FIG. 12.

The upper shield member 222 is relatively flat and includes a front cover 226 which is generally rectangular in shape and is arranged to cover the top surface 111 (and the lower shield member 224 is arranged to cover the lower surface 113 opposite of the top surface 111) with the front cover's leading edge 228 almost or in line with the front edge 118 of the mating section 112. The upper shield member 222 further includes a pair of opposing side shields 230,232 extending from sides 234 of the front cover 226 and the opposing side shields 230,232 are arranged to hug external surfaces of the corresponding first and second side arms 128,130 so that the upper shield member 222 rest snugly on the top portion 120 of the insulative housing 102.

The upper shield member 222 further includes a resiliently biased linkage section having a pair of linkages 238,240 which extends from the front cover's trailing edge 236 and terminates at a loop member 242. Each linkage has a spring-like geometry to be displaceable or retractable so as to absorb impact during mating. The loop member 242 of the upper shield member 222 is looped around a protrusion 244 formed on the top portion 120 of the insulative housing 102.

In use, the electrically conductive shield 220 comprising the upper shield member 222 and the lower shield member 224 are particular useful to reduce the effects of EMI. For example, area AA illustrated in FIG. 12 represents probable presence of external noise generated by surrounding electronic components or the mating connector. As it would be appreciated, such external noise is undesirable and affects signal integrity and transmission speed of the electrical signals. The electrically conductive shield 220 is arranged to resonate with such external noise to reduce the undesirable effects of EMI.

In addition to reducing the effects of EMI, the electrically conductive shield 220 also assist to absorb impact when the deflectable plug connector 200 is mated with the mating connector. Areas BB and CC in FIG. 12 illustrate areas of the deflectable plug connector 200 which are likely to make first contact with portions of the mating connector during mating. During the mating process, and in particular when there is exceeding insertion force, the portions of the mating connector would engage the leading edge 228 of the front cover 226 of the upper shield member 222 (and similarly for the lower shield member 224) and this causes the upper shield member 222 to deflect or retract (see arrow AB) to a retracted position which exposes the top surface 111 of the mating section 112 (and similarly, the lower shield member 224 also retracts to expose the lower surface 113) to allow the mating process.

When the mating connector disengages from the deflectable plug connector 200, the upper shield member 222 and the lower shield member 224 bias back to their initial positions which cover the mating section 112 as described earlier and shown in FIG. 12.

As a result, the electrically conductive shield is able to absorb impact during the mating process and thus, reduces damage to the insulative housing 102 and/or the circuit board 104.

Figure 13:
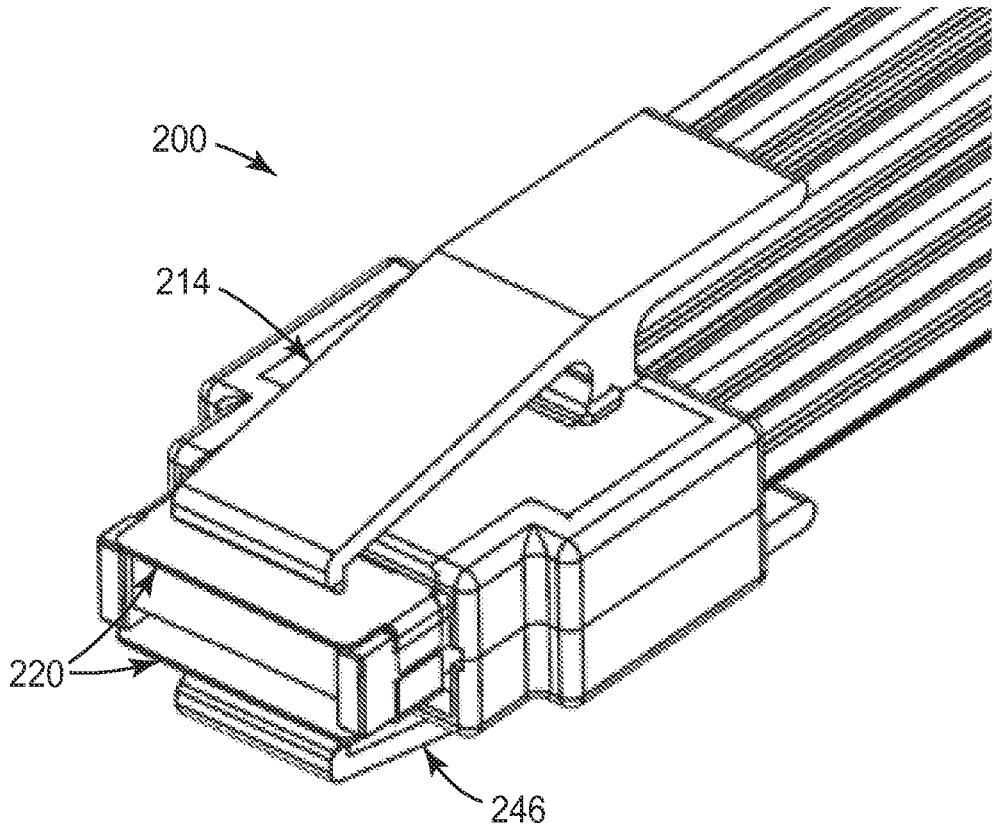
FIG. 13 is a perspective view of the deflectable plug connector of FIG. 7 with a modified latch mechanism.
Figure 14:
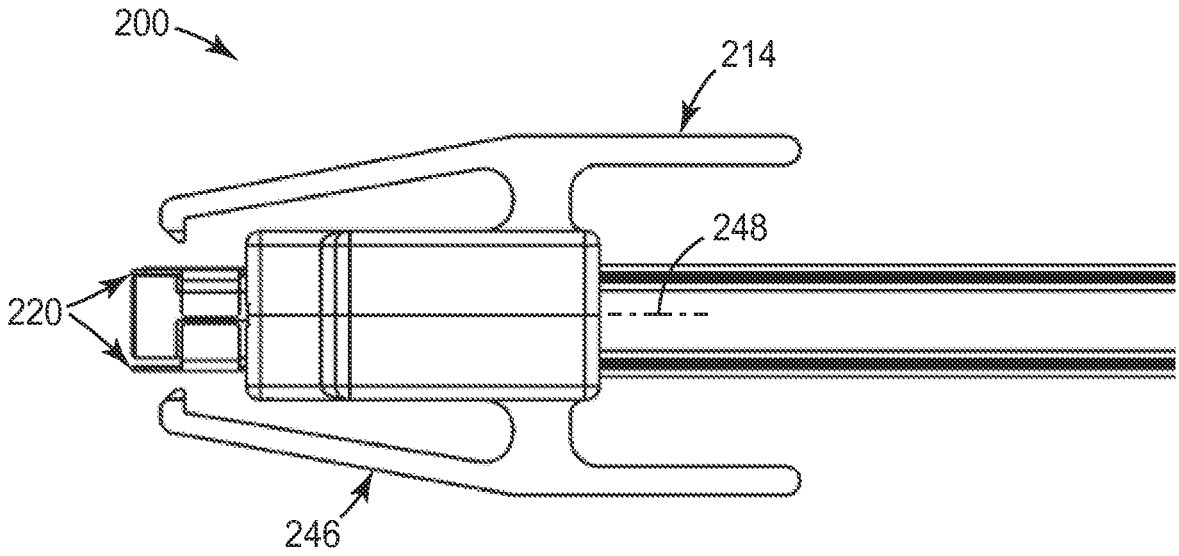
FIG. 14 is a side view of the deflectable plug connector of FIG. 13.

It should be appreciated that the electrically conductive shield 220 may take other shapes and structures to be resiliently retractable or displaceable and indeed, it may suffice that the electrically conductive shield 220 is arranged to cover only one of the major surfaces i.e. either the top surface 111 or the lower surface 113. In other words, there is only the upper shield member 222 without a need for the lower shield member 224 or vice versa. Also, the latch mechanism 208 may include a lower catch member 246 mounted to the bottom housing half 106 as shown in FIG. 13, which is a perspective view of the deflectable plug connector 200 of FIG. 7 and with the latch mechanism 208 modified to include the lower catch member 246. The lower catch member 246 is structurally similar to the upper catch member 210 and thus, no further explanation will be needed. However, it should be mentioned that with the lower catch member 146, the "dual" latch mechanism may provide increased stability and retains an optimal position of mated connectors and may enable better grips for users. In the deflectable plug connector 200 of FIG. 13, the upper and lower catch members 210,246 are symmetrical about a centre axis 248, although they may also be asymmetrical and of different geometries.

Figure 15:
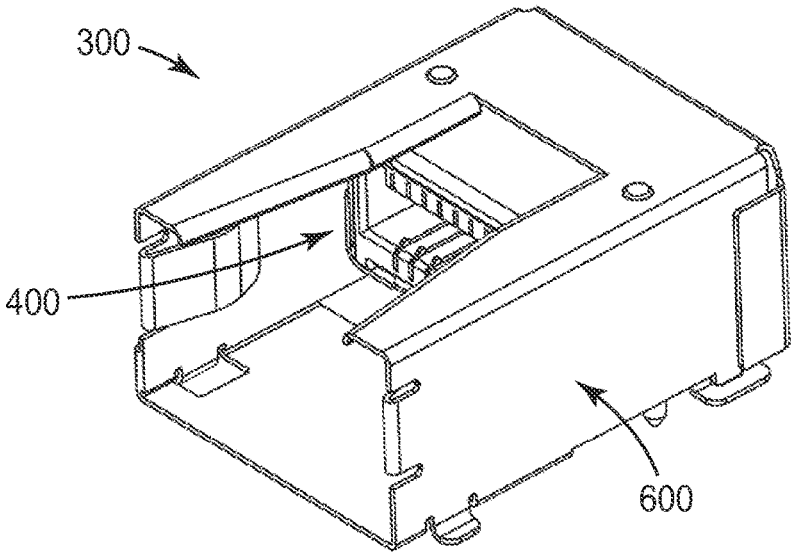
FIG. 15 is a perspective view of a connector assembly according to a third embodiment which comprises a shielded connector and a cage arranged to receive the shielded connector.

FIG. 15 is a perspective view of a connector assembly 300 according to a third embodiment which comprises a shielded connector 400 and a cage 600 arranged to receive the shielded connector 400. In the third embodiment, the connector assembly 300, and specifically the shielded connector 400, is configured as a receptacle connector for mating with the deflectable plug connector of FIG. 13. Needless to say, other types of connectors, not just the deflectable plug connector 200 of the second embodiment, may be mated with the connector assembly 300.

Figure 16:
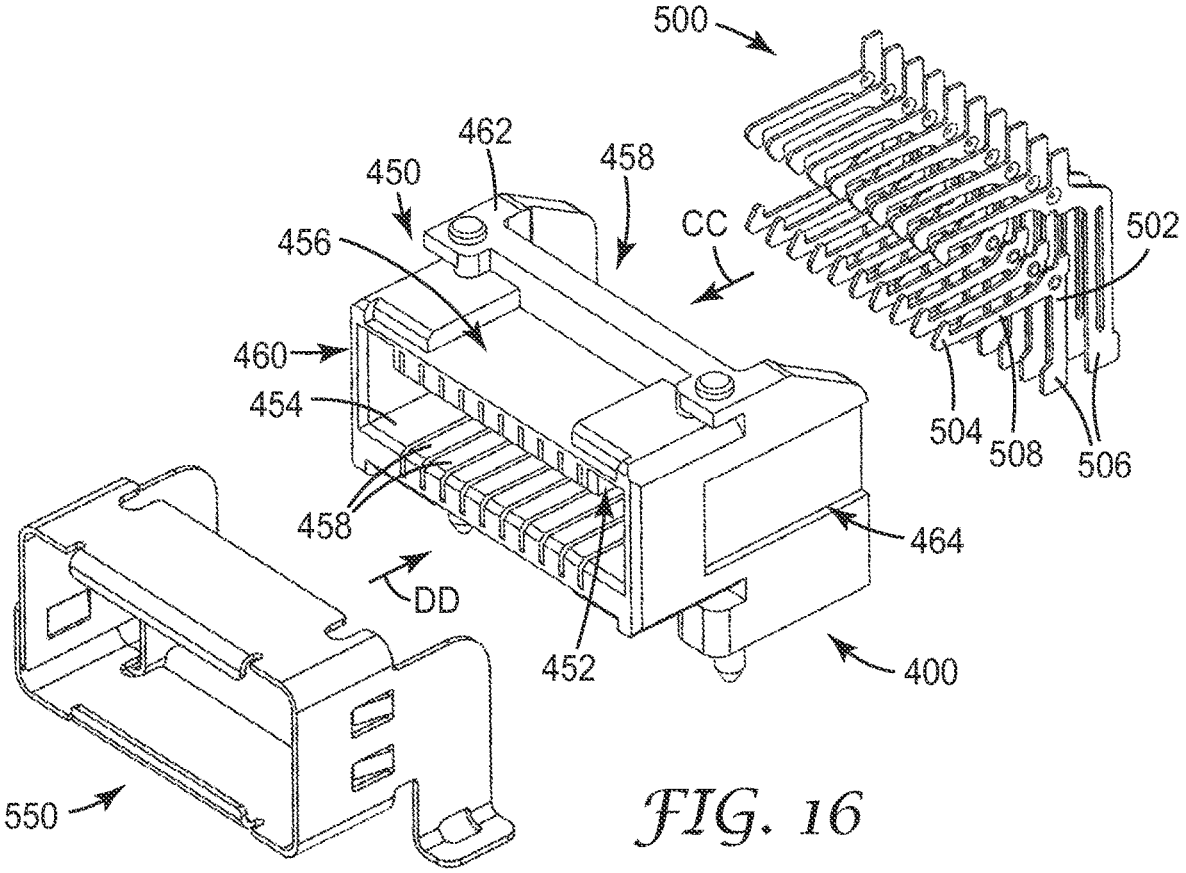
FIG. 16 is an exploded view of the shielded connector illustrating an insulative housing, a terminal module and an electrically conductive bracket of the shielded connector.

As shown in FIG. 16, the shielded connector 400 comprises an insulative connector housing 450, a terminal module 500 and an electrically conductive shield in the form of a bracket 550. The insulative connector housing 450 includes a top housing wall 452, an opposing a bottom wall housing 454, side housing walls 462,464 to define a connector mating section 456 (for the shielded connector 400) which has a plurality of passageways 458, each spaced apart from another and disposed between the top and bottom walls 452,454. The terminal module 500 is arranged to be received in the insulative connector housing 450 (as shown by arrow CC) and includes a plurality of electrically conductive contacts 502 with each conductive contact 502 being disposed in a corresponding passageway 458 of the insulative connector housing 450.

Each conductive contact 502 includes a contact portion 504 arranged to be disposed in the mating section 456 for making electrical contact with a corresponding contact of a mating connector and as explained above, the mating connector in this embodiment is the deflectable plug connector 200. Each conductive contact 502 also includes a termination portion 506 extending outwardly from a rear 458 of the insulative connector housing 450 and a middle portion 508 connecting the contact portion 504 to the termination portion 506. With the terminal module 500 inserted into the insulative connector housing 450, this subassembly is next inserted into the bracket 550 (see arrow DD) and FIG. 18 shows a more detailed view of the bracket 550.

The bracket 550 includes a bracket body 552 shaped and adapted to match an external of at least the mating section 456 of the shielded connector 400 to enable the bracket 550 to be assembled via a front 460 of the insulative connector housing 450 to enclose the mating section 456. To elaborate, the bracket body 552 includes a top bracket wall 554 and an opposing bottom bracket wall 556 and side bracket walls 558,560. The bracket body 552 further include wing sections 562,564 extending from the corresponding side bracket walls 558,560 and which cover respective side housing walls 462,464 of the insulative connector housing 450. Each wing section 562,564 bends outwardly to form an engagement tab 566,568 having a tab aperture 567,569 near the bottom bracket wall 556 in order for the bracket 550 to be engaged with the cage 600, as will be explained later.

FIG. 19 including FIGS. 19*a* to 19*g* show details of the cage 600 which is electrically conductive just like the bracket 550. The cage 600 includes a top cage wall 602 defining a top wall opening 604 at a front 606 of the top cage wall 602 and an opposing bottom cage wall 608 defining a bottom wall opening 610 at a rear 612 of the bottom cage wall 608. The cage 600 further includes opposing side cage walls 614,616 and a back cage wall 618 which cooperates with the top and bottom cage walls 602,608 to define a receiving space 620 (see FIG. 17) which communicates with a front opening 622 at the front 606 of the top cage wall 602. It should be appreciated that the front opening 622 together with the top wall opening 604 allows the deflectable plug connector 200 to be inserted into the receiving space 620 for the deflectable plug connector 200 to be electrically coupled to the shielded connector 400. The bottom wall opening 610 of the bottom cage wall 608 adjacent to the back wall allows the shielded connector 400 to be received by the cage 600.

Figure 20A:
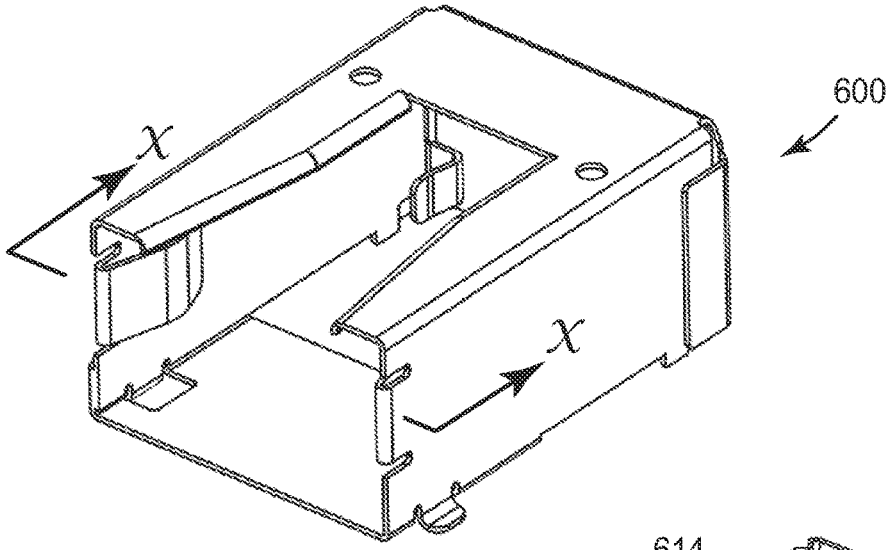
FIG. 20 includes FIG. 20*a* which is a perspective view of the cage of FIG. 19*a*, FIG. 20*b* which is a lower sectional view of the cage of FIG. 19*a* in a direction X-X.
FIG. 20*c* is a top plan view of the sectional cage view of FIG. 20*b;*
Figure 20B:
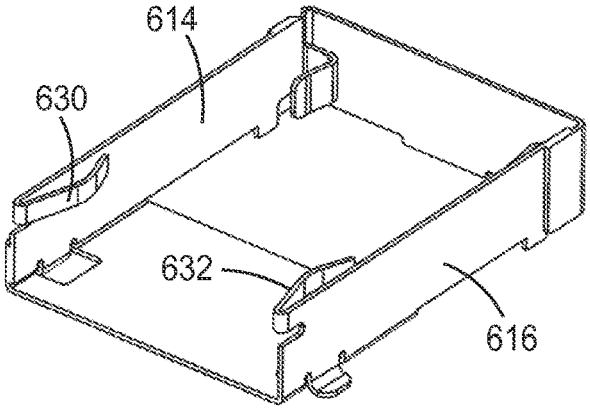
Figure 20C:
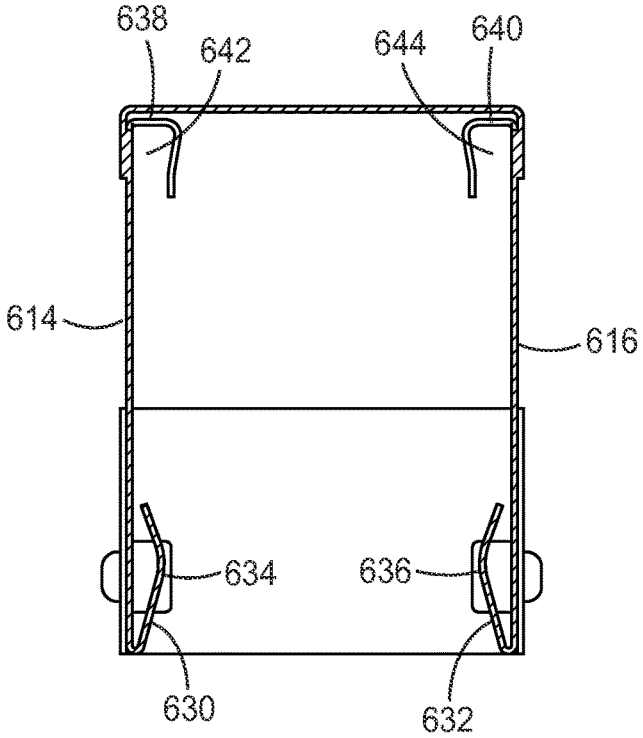

The cage 600 further includes two engagement lugs 624 with each engagement lug 624 formed on each side cage wall 614,616 adjacent the bottom cage wall 608 and near the front opening 622. Further, the cage 600 includes two engagement legs 626,628 with each engagement leg 626,628 formed on each side cage wall 614,616 near the bottom wall opening 610 and the back cage wall 618. Further, at each side cage wall's internal surface, there is an engagement mechanism for engaging the deflectable plug connector 200 and the shielded connector 400. In this embodiment, the engagement mechanism includes two front spring clips 630,632 attached to the respective side cage wall 614,616 near the front opening 622 which can be seen more clearly from FIG. 20 and in particular, FIG. 20*b* which is a sectional view of the cage of FIG. 20*a* in the direction X-X, and FIG. 20*c* is a top plan view of the cage sectional view of FIG. 20*b*. The two front spring clips 630,632 are bent inwardly to create respective biased abutment surfaces 634,636 for frictional engagement with the deflectable plug connector 200 which assist to hold the connectors together.

The engagement mechanism further includes two rear spring clips 638,640 attached to the respective side cage wall 614,616 near the back cage wall 618 and near the bottom wall opening 610. Unlike the two front spring clips 630,632, the two rear spring clips 638,640 include clip openings 642,644 arranged to frictionally engage the rear of the shielded connector 400 and specifically, the side housing walls 462,464 of the insulative connector housing 450 and the wing sections 562,564 of the bracket 550. In this way, the shielded connector 400 is securely coupled to the cage 600.

Figure 17:
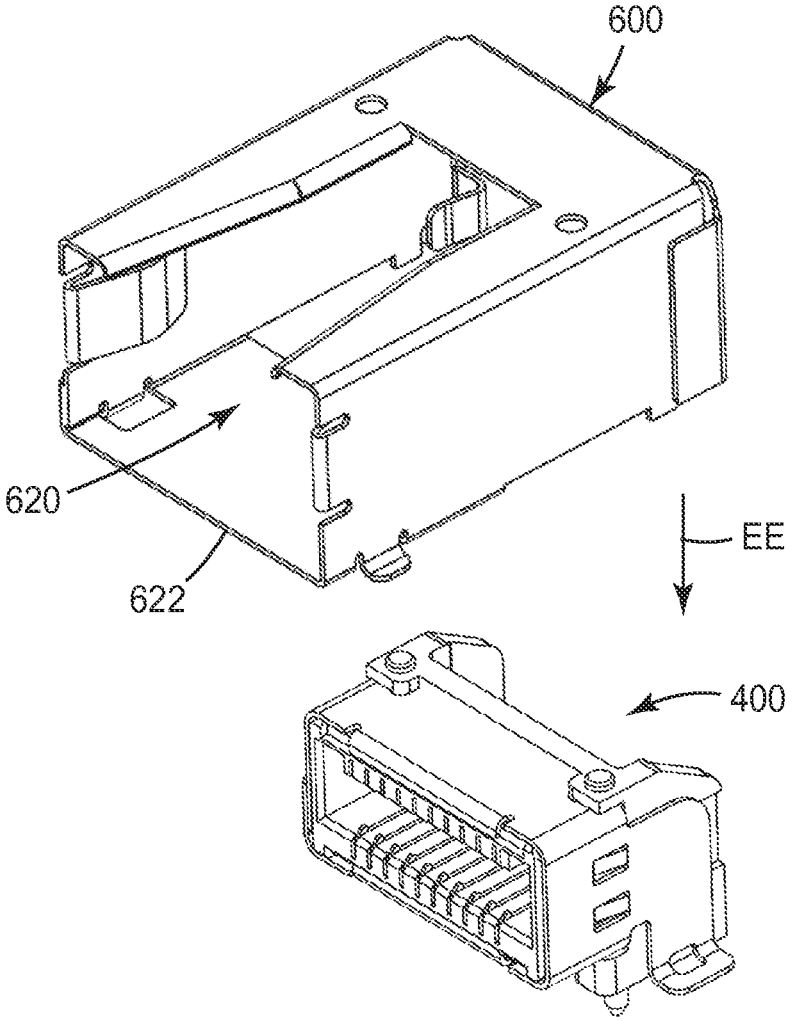
FIG. 17 is an assembled view of the shielded connector of FIG. 16 and with the cage shown separately.
Figure 18A:
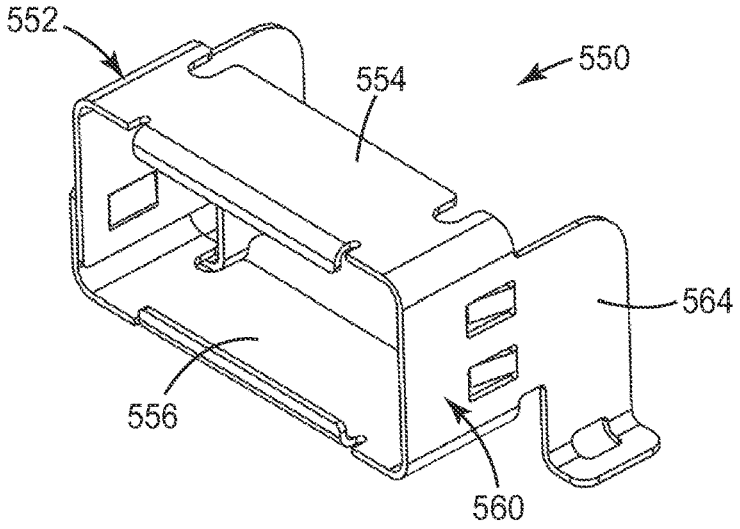
FIG. 18 includes FIG. 18*a* which is a perspective view of the bracket of FIG. 16, FIGS. 18*b* to 18*f* are respective top, front, bottom, view from one side and view from the other side of the bracket of FIG. 18*a;*
Figure 18B:
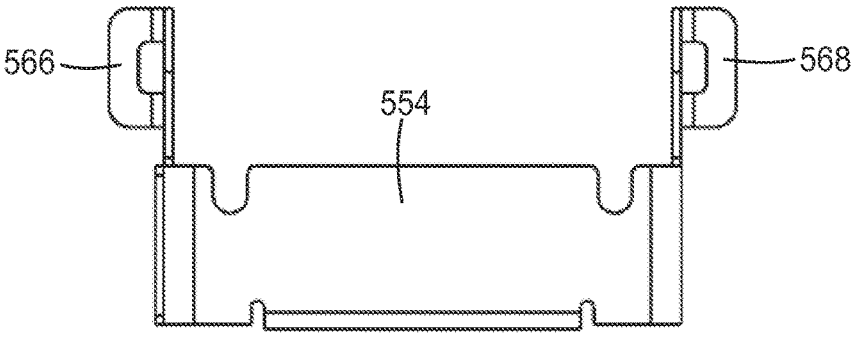
Figure 18C:
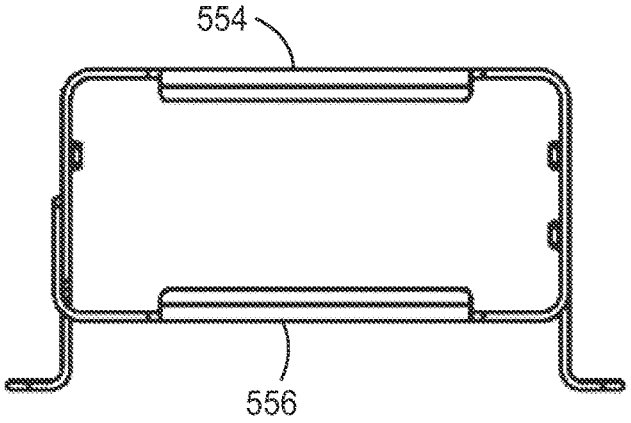
Figure 18D:
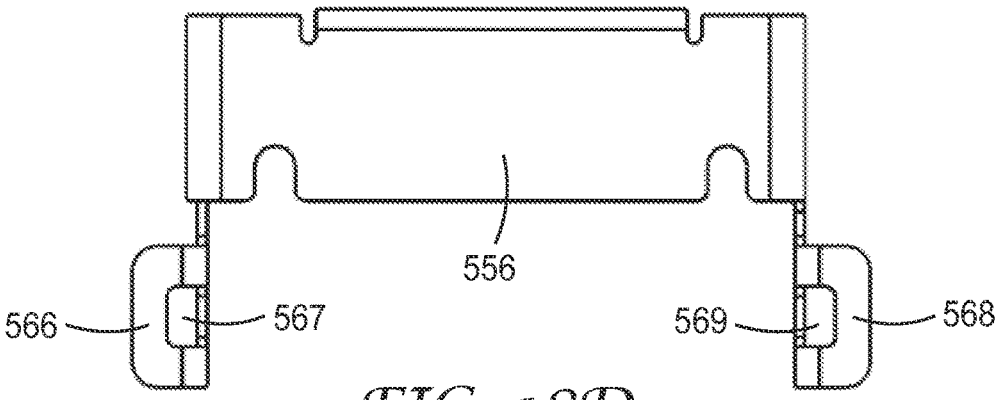
Figure 18E:
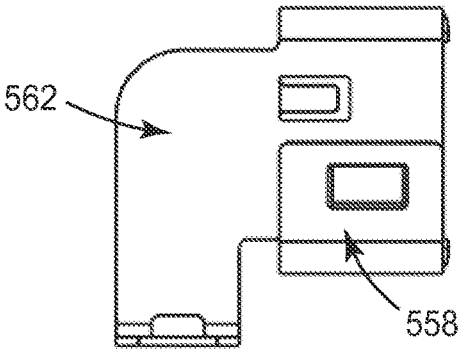
Figure 18F:
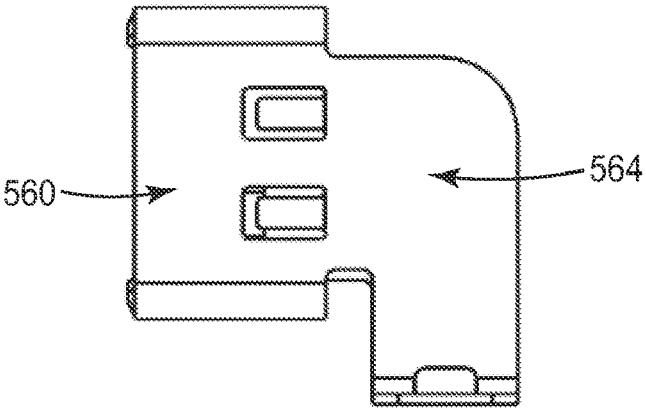
Figure 19A:
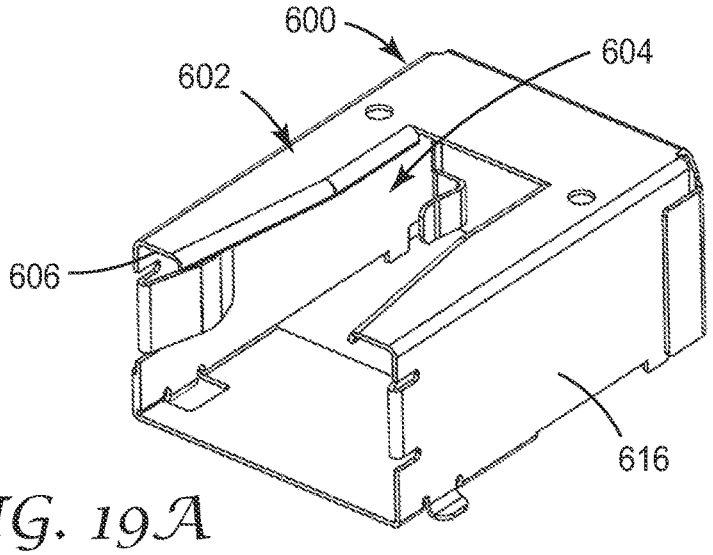
FIG. 19 includes FIG. 19*a* which is a perspective view of the cage of FIG. 17, FIGS. 19*b* to 19*g* are respective top, front, bottom, view from one side and view from the other side, and rear view of the cage of FIG. 19*a;*
Figure 19B:
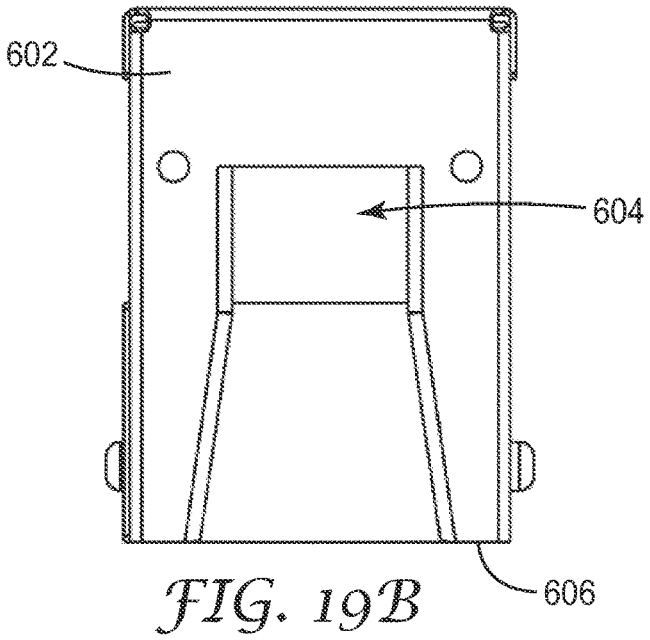
Figure 19C:
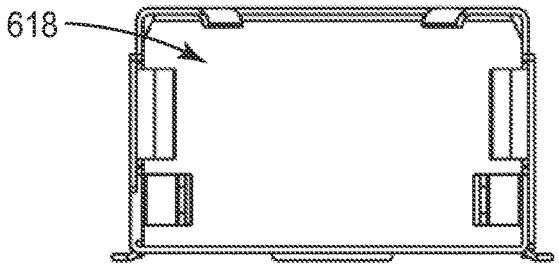
Figure 19D:
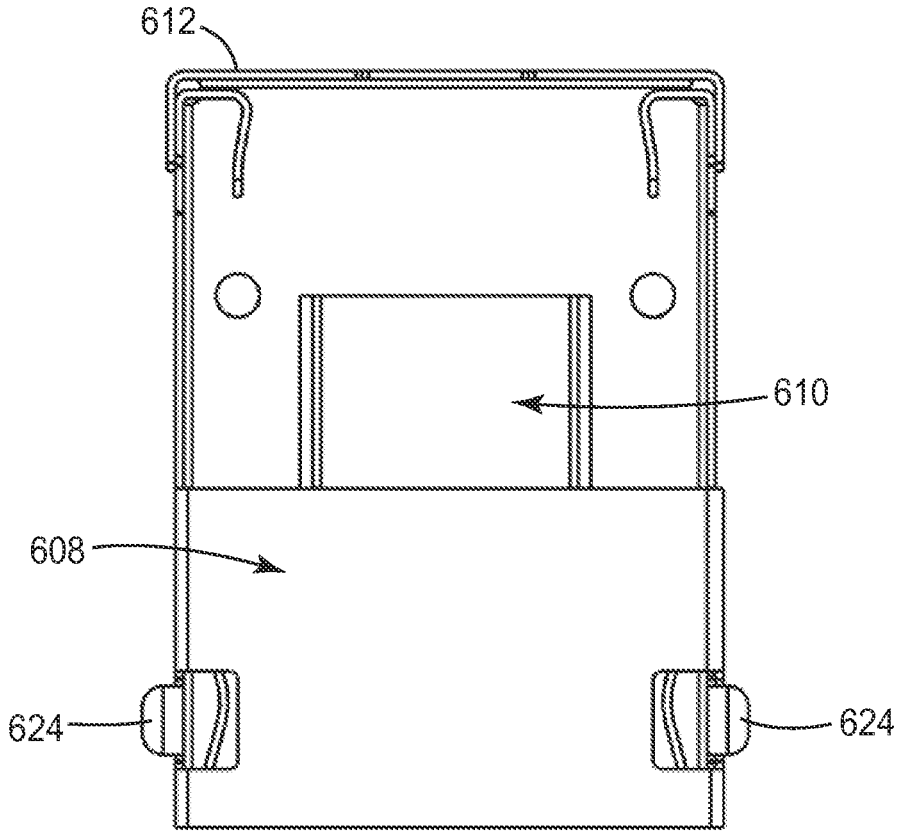
Figure 19E:
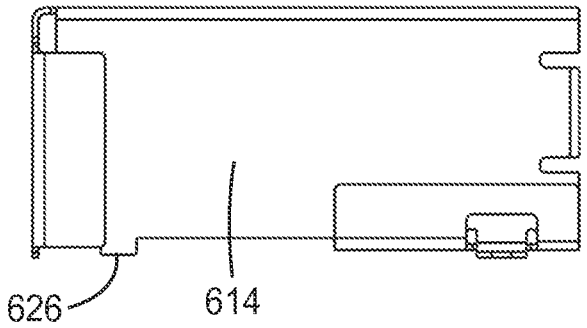
Figure 19F:
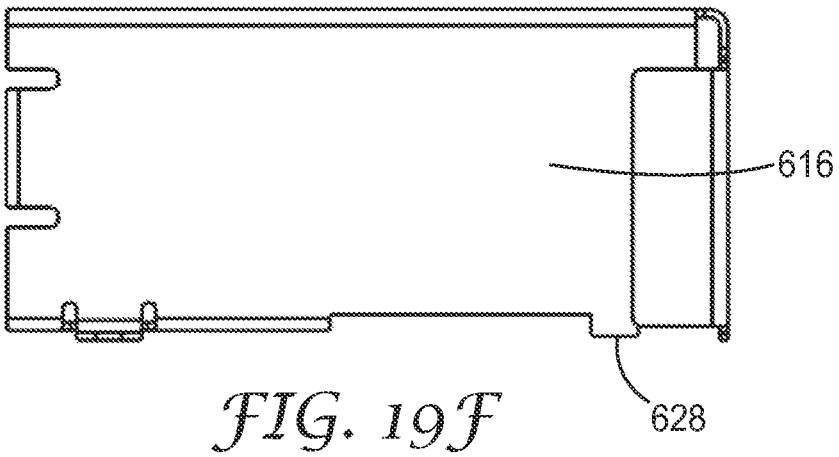
Figure 19G:
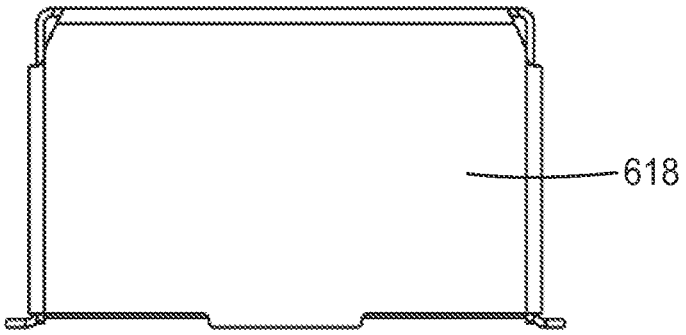
Figure 21A:
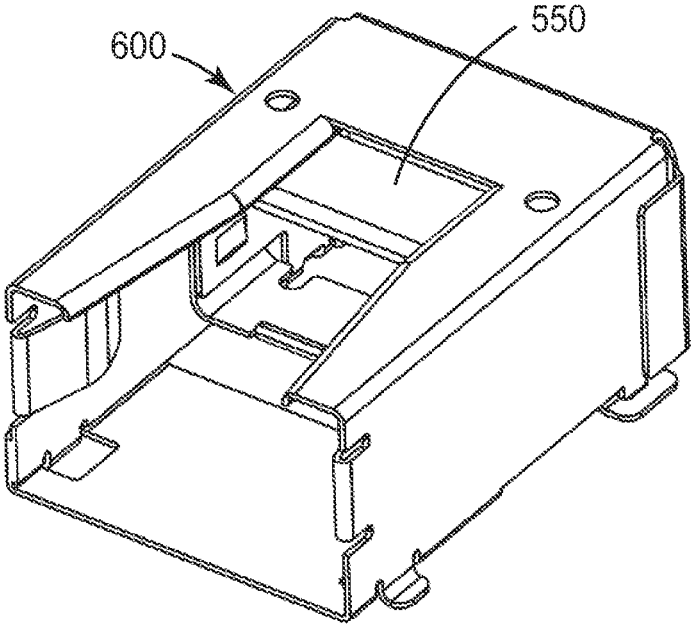
FIG. 21 includes FIG. 21*a* which is a perspective view of the connector assembly of FIG. 15 but without showing the insulative housing and the terminal module.
FIG. 21*b* which is a bottom perspective view of the connector assembly of FIG. 21*a*, FIG. 21*c* which is an enlarged view of portion FF of FIG. 21*b*.
FIG. 21*d* is an enlarged view of portion GG of FIG. 21*b;*
Figure 21B:
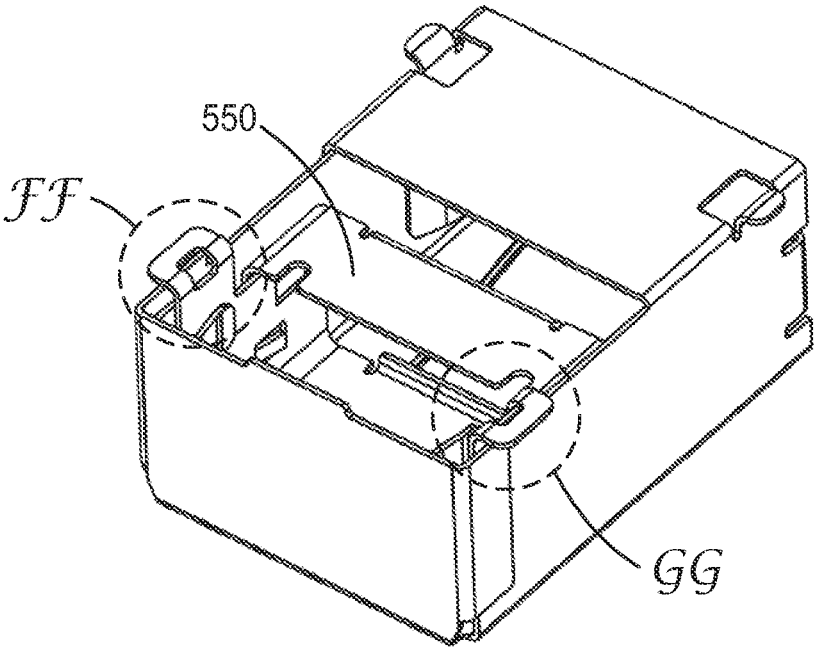
Figure 21C:
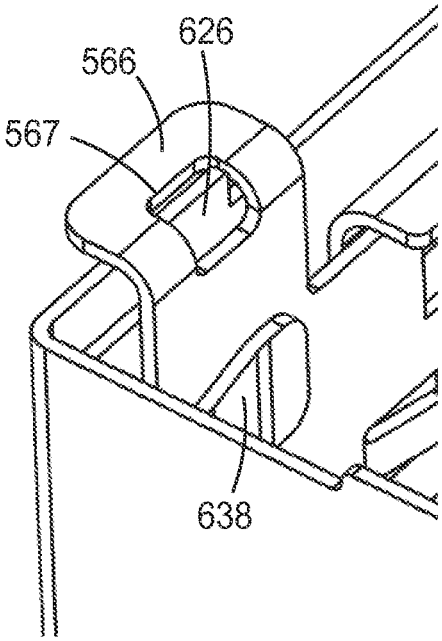
Figure 21D:
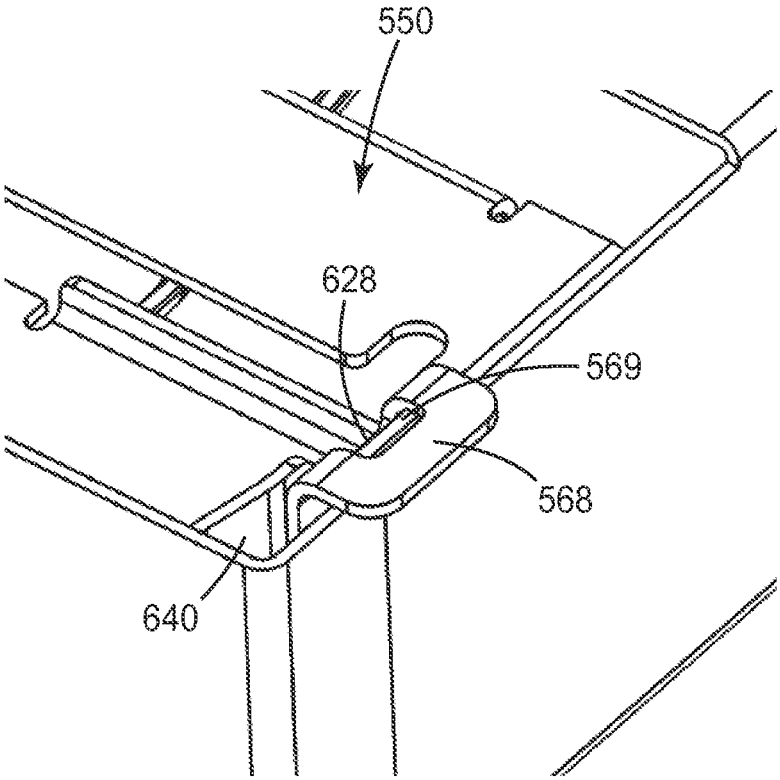

Referring to FIG. 17, the shielded connector 400 is received into the cage 600 via the bottom wall opening 610 (as shown by arrow EE) and the engagement legs 626,628 are inserted into the corresponding tab aperture 567,569 of the engagement tabs 566,568. This engagement may be seen more clearly from FIG. 21 with FIG. 21*a* showing a perspective view of the connector assembly 300 but without the insulative housing 450 and the terminal module 500 and only the bracket 550. FIG. 21*b* is a bottom perspective view of the connector assembly 300 of FIG. 21*a*, FIG. 21*c* is an enlarged view of portion FF of FIG. 21*b*, and FIG. 21*d* is an enlarged view of portion GG of FIG. 21*b*. From these figures, it should also be appreciated that two rear spring clips 638,640 are arranged to engage each aligned set of the side housing wall 462,464 of the insulative connector housing 450 and wing sections 562,564 of the bracket 550, although in these figures only the wing sections 562,564 of the bracket 550 is shown to be clipped by the rear spring clips 638,640.

When assembled, it can be seen from FIG. 15 that the top cage opening 604 partially exposes the bracket 550 (i.e. electrically conductive shield) of the shielded connector 400 and this arrangement may be useful to reduce the effects of EMI when the connector assembly 300 is mated with the deflectable plug connector 200 as will be explained with reference to FIGS. 22 and 23.

Figure 22:
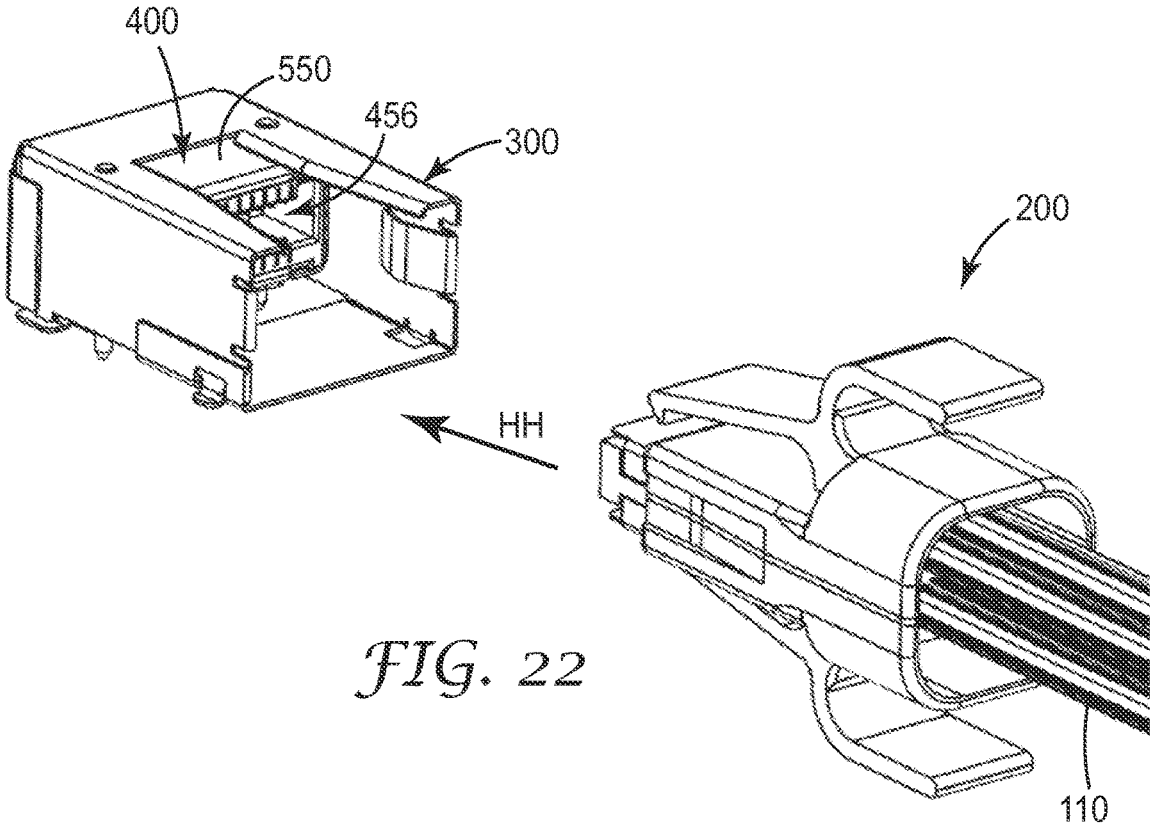
FIG. 22 illustrates how the connector assembly of FIG. 15 is arranged to be connected to the deflectable plug connector of FIG. 13.
Figure 23:
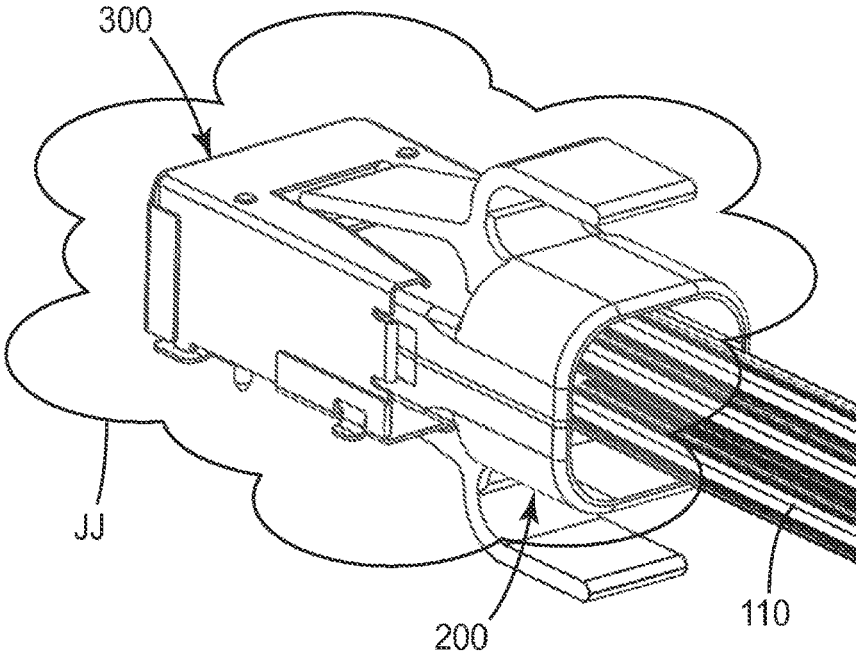
FIG. 23 illustrates a mated connector pair comprising the connector assembly and the deflectable plug connector of FIG. 22.

FIG. 22 illustrates the connector assembly 300 of FIG. 15 ready to be mated with the deflectable plug connector of FIG. 13 in a mating direction HH and as the deflectable plug connector 200 is inserted into the receiving space 620 of the connector assembly 300, the biased abutment surfaces 634, 636 of the two front spring clips 630,632 engage with externals surfaces of the deflectable plug connector 200 and when the retractable electrically conductive shield 220 engages the shielded connector 400 (more specifically the mating section 456 of the shielded connector 400), the bracket 550 contacts the retractable electrically conductive shield 220 and causes the shield 220 to retract to the retracted position but the EMI shielding is still achieved or maintained in view of the bracket 550 which takes the place of the retracted shield 220 to shield the mated connector assembly 300 and the deflectable plug connector 200 as shown in FIG. 23.

As a result, the mating section 456 of the shielded connector (in particular the contact portions 504 of the terminal module) and the circuit board 104 of the mating section 112 of the deflectable plug connector 200 are shielded from EMI by the conductive cage 600 and the bracket 550. This integrated shielding minimises degradation of signal integrity of the signal transmission, in particular in a region JJ which is an area of potential EMI exposure.

It should be appreciated that the connector assembly 300 and the deflectable plug connector 200 provide their own shielding in an unmated configuration i.e. the electrically conductive shield in the form of the bracket 550 for shielding the mating section 456 of the connector assembly 300, and the (retractable) electrically conductive shield in the form of the upper shield member 222 and the lower shield member 224 for shielding the mating section 112 of the deflectable plug connector 200. As mentioned earlier and in relation to FIG. 1, the mating section 112 of the circuit board 104 may include contact pads which are considered broadly as "terminals" which are arranged to make electrical contact with terminals of the terminal module 500 i.e. the plurality of electrically conductive contacts 502.

When the deflectable plug connector 200 mates with the connector assembly 300 as explained above, the contact pads of the mating section 112 of the deflectable plug connector 200 makes electrical contact with respective ones of the plurality of electrical contacts 502 of the terminal module 500, one of the electrically conductive shield displaces (as there is a redundancy of the shields shielding the respective mating sections 112,456) and in this embodiment, it is the upper and lower shield members 224,226 of the deflectable plug connector 200 which are retracted resiliently, and the electrically conductive shield of the connector assembly 300 in the form of the bracket 550 provides shielding for both the mating sections 112,456 (and thus, the contact pads and the electrical contacts 502 when connected to each other).

Again, when the deflectable plug connector 200 unmates or is uncoupled from the connector assembly 300, the retracted upper and lower shield members 224,226 return to their original position and again provides shielding for the mating section 112 and the contact pads.

It should be apparent that the retractable electrically conductive shield may be provided at either the deflectable plug connector 200 or the connector assembly 300 or indeed at any one of two mating connectors, and not necessary at the deflectable plug connector 200.

The described embodiments should not be construed as limitative. For example, in the first and second embodiments, the first and second side arms 128,130 which provide alignment during mating, is illustrated as symmetrical but this may not be so and the first and second side arms may be asymmetrical or may have different geometries and these may further aid as a polarisation feature. Also, the first and second side arms 128,130 may not be a pair, and a single side arm or multiple guide arms may be placed at either lateral side portions of the printed circuit card with respect to a mating direction. Also, the outer shell housing 132 may have different geometries and not restricted to what is illustrated in the drawings.

The deflectable plug connector 200 in the second embodiment is described to include the plug connector 100 of the first embodiment. However, it should be apparent that this may not be necessary and the features of the deflectable plug connector 200, such as the electrically conductive shield 220 and the latch mechanism 208, may be applied to other types of connectors. Also, the latch mechanism 208 and outer housing 202 may not be necessary. The electrically conductive shield 220 may also take other forms, shapes and geometries and may not be in the form of the upper shield member 222 and the lower shield member 224.

Although the third embodiment is described using the plug connector 100 of the first embodiment, it should be appreciated that features of the deflectable plug connector 200 may be used with other connectors and in particular the deflectable plug connector 200 may not have the first and second side arms 128,130 or the maximum separation distance being sufficiently small between the side arms 128,130 and the corresponding side edges 114,116. Also, the bracket 550 is used as an example of an electrically conductive shield in the third embodiment and the electrically conductive shield may take other forms. Similarly, the number and type of the front and rear spring clips 630,632,638,640 may be changed and modified according to requirements, and likewise of the engagement legs 626,628 and the engagement tabs 566,568.

Indeed, further enhancements may be made to the plug connector 100, deflectable plug connector 200 and the connector assembly 300 and an exemplary improvement relates to the insulative connector housing 450 and the terminal module 500 and when both parts are arranged together, they are broadly "a connector" but the term "terminal connector" will be used for easier explanation. Convention terminal connectors may be used as part of the connector assembly 300 but the connector assembly 300 may include a terminal connector 700 as illustrated in FIGS. 24 and 25.

Using the references of the third embodiment, the insulative connector housing 450 includes the top housing wall 452, the opposing a bottom wall housing 454 and the side housing walls 462,464 to define the connector mating section 456 (for the shielded connector 400) which has a plurality of passageways 458, each spaced apart from another and disposed between the top and bottom walls 452,454. From FIG. 25, it can be appreciated that the terminal module 500 is arranged to be received in the insulative connector housing 450 and each one of the plurality of electrically conductive contacts 502 is disposed in a corresponding passageway 458 of the insulative housing.

Each conductive contact 502 includes the contact portion 504 arranged to be disposed in the mating section 456 for making electrical contact with a corresponding contact of a mating connector (such as the deflectable plug connector 200 as described earlier), the termination portion 506 extending outwardly from the rear 458 of the insulative connector housing 450 and the middle portion 508 connecting the contact portion 504 to the termination portion 506.

Figure 24:
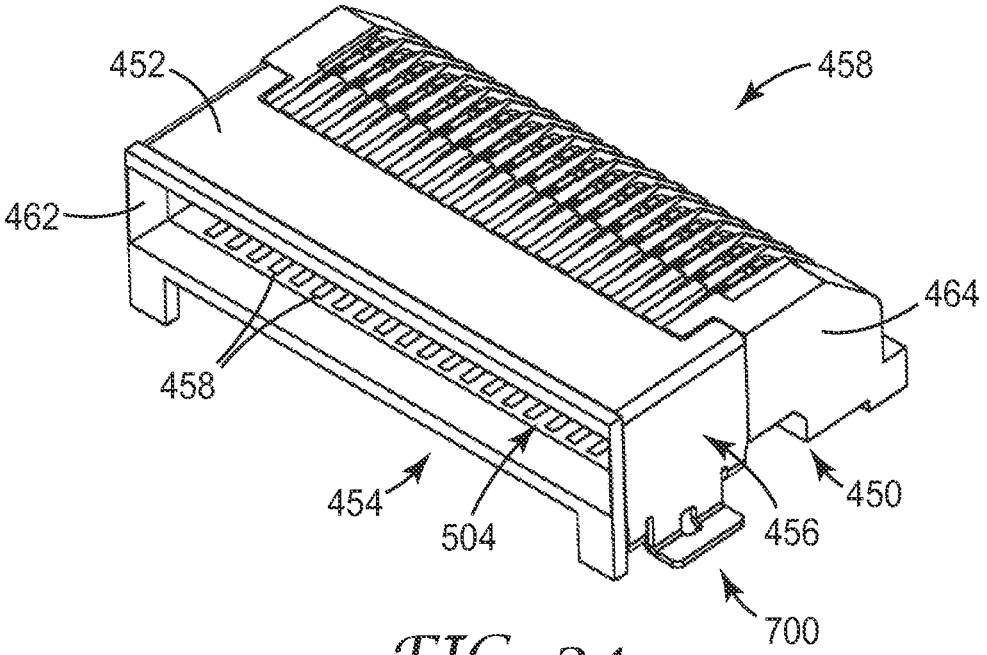
FIG. 24 is a front perspective view of an exemplary terminal connector which may be used in the connector assembly of FIG. 15.
Figure 25:
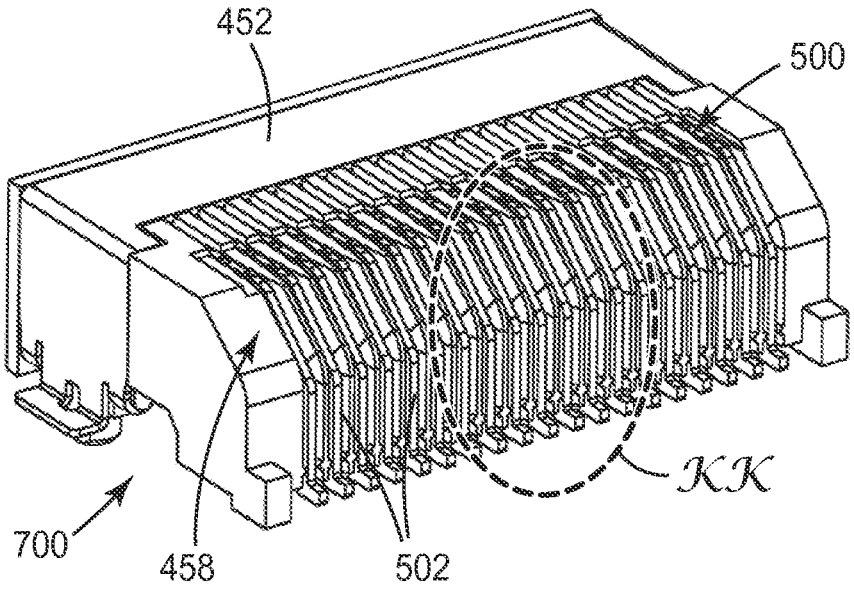
FIG. 25 is a rear perspective view of the exemplary terminal connector of FIG. 24.
Figure 26:
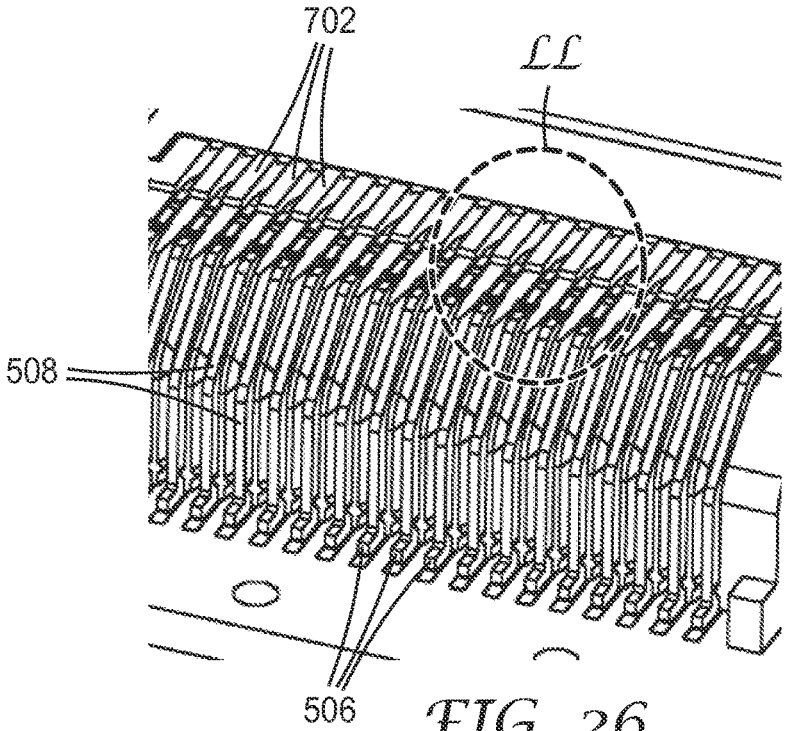
FIG. 26 is an enlarged view of region KK of the terminal connector of FIG. 25.
Figure 27:
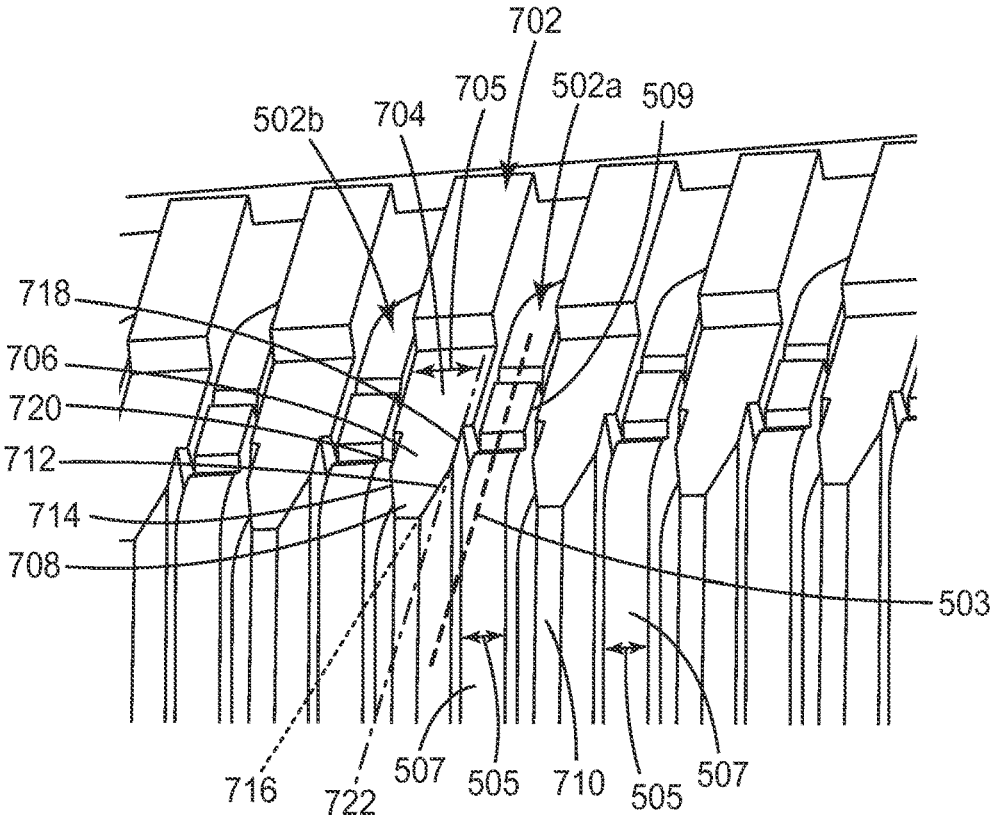
FIG. 27 is an enlarged view of region LL of region KK of the terminal connector of FIG. 25.

As it can be appreciated from FIGS. 24 and 25, each one of the plurality of passageways 458 is defined by opposing sidewalls 702 with similar geometric construction. The geometric construction of one of the sidewalls 702 will be described with reference to FIG. 25 in relation to two of the electrically conductive contacts 502, which are labelled as first and second electrical contacts 502*a*,502*b* for easier explanation.

The sidewall 702 of FIG. 25 includes a base 704, an intermediate section 706 extending outwardly from the base 704 and a peak section 708 extending outwardly from the intermediate section 706. The base 704 has a base width 705 which is as close to a width 505 of the first and second electrical contacts 502*a*,502*b*, or the widths may be substantially the same. The peak section 708 includes a peak 710 of the sidewall 702 which is substantially aligned with or matches a highest point 507 of the first and second electrical contacts 502*a*,502*b*. The peak section 708 includes a first tapered cross-section defined by opposing tapered first planar surfaces 712,714 and it should be appreciated that each first planar surface 712,714 is arranged to face the respective first and second electrical contacts 502*a*,502*b*. Referring to the first electrical contact 502*a*, the first electrical contact 502*a* has a contact plane 503 which is parallel to an axis of a first portion 509 of the first electrical contact 502*a* which immediately extends out from the rear 458 of the insulative connector housing 450.

In view of the tapered cross-section, the first planar surface 712 facing the first electrical contact 502*a* has a first planar surface axis 716 (parallel to the first planar surface 712) and the first planar surface axis 716 forms a first acute angle of 4° to 11° with the contact plane 503.

The intermediate section 706 has a second tapered cross-section (which has a different taper angle as the first tapered cross-section) which is defined by opposing tapered second planar surfaces 718,720 and it should be appreciated that each second planar surface 718,720 is arranged to face the respective first and second electrical contacts 502*a*,502*b*. Again, with reference to the first electrical contact 502*a*, the second planar surface 718 facing the first electrical contact 502*a*, which extends downwardly from the first planar surface 712 facing the first electrical contact 502*a*, has a second planar surface axis 722 (parallel to the second planar surface 718) and the second planar surface axis 722 forms a second acute angle with the contact plane 503 with the second acute angle being less than the first acute angle. Preferably, the second acute angle may be substantially equal to zero or zero i.e. the second planar surface axis 722 is parallel to the contact plane 503.

With such a sidewall 702 structure or geometry, it is possible to address high impedance mismatch exhibited by conventional terminal connectors. In particular, the impedance mismatch may be reduced to meet a nominal 100 Ohms typical requirement and this may be useful to improve or enhance the performance of the connector assembly 300. The structure of the sidewall 702 may also reduce material for making the sidewall 702 while maintaining an acceptable base width 705 to prevent contact between the electrically conductive contacts 502.

While the invention has been illustrated and described in detail in the drawings and foregoing description, such illustration and description are to be considered illustrative or exemplary, and not restrictive; the invention is not limited to the disclosed embodiments. Other variations to the disclosed embodiments can be understood and effected by those skilled in the art in practising the claimed invention.

The invention claimed is:

1. A connector comprising:

an insulative housing defining a rear opening for receiving a plurality of electrical wires and a front opening;

a circuit board disposed in the housing and comprising a mating section for mating with a corresponding mating section of a mating connector, the mating section protruding outwardly from the front opening and terminating at a front edge disposed between opposing side edges of the mating section; and at least one side arm extending forwardly from a lateral side of the front opening along, adjacent and beyond one of the side edges of the mating section, a maximum separation between the side edge and the at least one side arm being sufficiently small so that when the connector mates with a mating connector, no portion of the mating connector can be inserted between the side edge and the at least one side arm.

2. The connector of claim 1, wherein the at least one side arm makes physical contact with the corresponding side edge of the mating section.

3. The connector of claim 1, wherein the maximum separation between the at least one side arm and the corresponding side edge is zero.

4. The connector of claim 1, wherein the at least one side arm is overmolded on at least a portion of the corresponding side edge of the circuit board.

5. The connector of claim 1, wherein the at least one side arm is overmolded on the circuit board.

6. The connector of claim 1, wherein the at least one side arm includes a side arm centre axis which is offset from the front edge's centre axis.

7. The connector of claim 1, further comprising an outer shell housing arranged to enclose the insulative housing.

8. The connector of claim 7, further comprising a latch mechanism mounted to the outer shell housing and for engaging with a mating connector.

9. The connector of claim 8, wherein the latch mechanism comprises at least one catch member for engaging with a mating connector.

10. The connector of claim 1, further comprising an electrically conductive shield covering a major surface of the mating section of the circuit board and being resiliently retractable to a retracted position exposing the major surface of the mating section.

11. The connector of claim 10, wherein the major surface is a top surface of the mating section.

12. The connector of claim 1, wherein the at least one side arm includes opposing side arms extending from opposing lateral sides of the front opening along, adjacent and beyond corresponding side edges of the mating section, wherein the maximum distance between each side edge and the corresponding side arm is sufficiently small so that when the connector mates with the mating connector, no portion of the mating connector can be inserted between the side edge and the corresponding side arm.

* * * * *